US010608321B2

(12) United States Patent
Jiang et al.

(10) Patent No.: US 10,608,321 B2
(45) Date of Patent: Mar. 31, 2020

(54) ANTENNAS IN PATTERNED CONDUCTIVE LAYERS

(71) Applicant: Apple Inc., Cupertino, CA (US)

(72) Inventors: Yi Jiang, Cupertino, CA (US); Jiangfeng Wu, Santa Clara, CA (US); Lijun Zhang, San Jose, CA (US); Siwen Yong, Santa Clara, CA (US); Mattia Pascolini, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 123 days.

(21) Appl. No.: 15/602,956

(22) Filed: May 23, 2017

(65) Prior Publication Data

US 2018/0342789 A1 Nov. 29, 2018

(51) Int. Cl.

| | |
|---|---|
| ***H01Q 1/24*** | (2006.01) |
| ***H01Q 1/22*** | (2006.01) |
| ***H01Q 21/06*** | (2006.01) |
| ***H01Q 7/04*** | (2006.01) |
| ***H01Q 9/04*** | (2006.01) |
| ***H01Q 15/00*** | (2006.01) |
| ***H01Q 1/52*** | (2006.01) |

(52) U.S. Cl.

CPC ..... *H01Q 1/243* (2013.01); *H01Q 1/2266* (2013.01); *H01Q 1/528* (2013.01); *H01Q 7/04* (2013.01); *H01Q 9/0421* (2013.01); *H01Q 15/0013* (2013.01); *H01Q 21/065* (2013.01)

(58) Field of Classification Search

CPC ..... H01Q 1/24; H01Q 7/04; H01Q 1/528; H01Q 15/0013; H01Q 9/0421

USPC ..... 343/702

See application file for complete search history.

(56) References Cited

U.S. PATENT DOCUMENTS

| | | | |
|---|---|---|---|
| 6,919,862 | B2 | 7/2005 | Hacker et al. |
| 7,456,793 | B2 | 11/2008 | Napoles et al. |
| 7,884,315 | B2 | 2/2011 | Andre et al. |
| 8,270,914 | B2 | 9/2012 | Pascolini et al. |

(Continued)

FOREIGN PATENT DOCUMENTS

| | | | |
|---|---|---|---|
| CN | 103987223 | A | 8/2014 |
| CN | 104051844 | A | 9/2014 |

(Continued)

OTHER PUBLICATIONS

Mow et al., U.S. Appl. No. 15/217,805, filed Jul. 22, 2016.

*Primary Examiner* — Huedung X Mancuso

(74) *Attorney, Agent, or Firm* — Treyz Law Group, P.C.; Michael H. Lyons

(57) ABSTRACT

An electronic device may include a substrate and a conductive layer on the substrate. The conductive layer may be patterned to form a first region and a second region that surrounds and defines the shape of the first region. The first region may be formed from a continuous portion of the conductive layer. The second region may include a grid of openings that divides the conductive layer into an array of patches. The first region may form an antenna resonating element for an antenna. The second region may block antenna currents from the antenna resonating element and may be transparent to radio-frequency electromagnetic waves. The openings may have a width that is too narrow to be discerned by the human eye. This may configure the first and second regions to appear as a single continuous conductive layer despite the fact that an antenna resonating element is formed therein.

17 Claims, 13 Drawing Sheets

(56) References Cited

U.S. PATENT DOCUMENTS

| | | | |
|---|---|---|---|
| 8,446,333 | B2 | 5/2013 | Zhu et al. |
| 8,643,547 | B2 | 2/2014 | Hong et al. |
| 8,896,487 | B2 | 11/2014 | Chiang et al. |
| 2005/0007289 | A1 | 1/2005 | Zarro et al. |
| 2011/0014879 | A1 | 1/2011 | Alberth et al. |
| 2011/0298670 | A1 | 12/2011 | Jung et al. |
| 2012/0032858 | A1 | 2/2012 | Chang et al. |
| 2013/0293425 | A1 | 11/2013 | Zhu et al. |
| 2014/0361932 | A1 | 12/2014 | Irci et al. |
| 2015/0255856 | A1 | 9/2015 | Hong et al. |
| 2016/0093939 | A1 | 3/2016 | Kim et al. |
| 2016/0093941 | A1 | 3/2016 | Hsu et al. |
| 2016/0134008 | A1 | 5/2016 | Kim et al. |
| 2016/0192482 | A1 | 6/2016 | Radi et al. |
| 2016/0308271 | A1 | 10/2016 | Jin et al. |
| 2017/0117754 | A1 | 4/2017 | Noori et al. |

FOREIGN PATENT DOCUMENTS

| | | | |
|---|---|---|---|
| CN | 205029005 | U | 2/2016 |
| CN | 206076482 | U | 4/2017 |
| EP | 1496570 | A1 | 1/2005 |
| EP | 2764975 | | 8/2014 |
| EP | 2778830 | | 9/2014 |

ANTENNAS IN PATTERNED CONDUCTIVE LAYERS

BACKGROUND

This relates generally to electronic devices and, more particularly, to electronic devices with wireless communications circuitry.

Electronic devices often include wireless circuitry with antennas. For example, cellular telephones, computers, and other devices often contain antennas for supporting wireless communications.

It can be challenging to form electronic device antenna structures with desired attributes. In some wireless devices, the presence of conductive structures such as conductive housing structures can influence antenna performance. Antenna performance may not be satisfactory if the housing structures are not configured properly and interfere with antenna operation. Device size can also affect performance. It can be difficult to achieve desired performance levels in a compact device, particularly when the compact device has conductive housing structures.

It would therefore be desirable to be able to provide improved wireless circuitry for electronic devices such as electronic devices that include conductive housing structures.

SUMMARY

An electronic device may be provided with wireless circuitry. The wireless circuitry may include an antenna and transceiver circuitry. The antenna may include an antenna resonating element, an antenna ground, and an antenna feed having first and second feed terminals. The transceiver circuitry may be coupled to the antenna feed over a radio-frequency transmission line.

The electronic device may include a dielectric substrate and a conductive layer formed on the dielectric substrate. The conductive layer may include a conductive housing wall for the electronic device, a metal trace on a printed circuit board, a metal coating on a glass substrate, or any other desired conductive layer in the device. The conductive layer may be patterned to form a first region and a second region that surrounds at least some of the first region (e.g., that defines at least one edge of the first region). The first region may be formed from a continuous (solid) portion of the conductive layer that is free from openings. The second region may include a grid of openings in the conductive layer that divides the conductive layer into an array of conductive patches. The first region of the conductive layer may be coupled to the first feed terminal and may form the antenna resonating element for the antenna. The second antenna feed terminal may be coupled to the antenna ground. Antenna currents may flow through the first region of the conductive layer and the antenna ground.

The second region of the conductive layer may be configured to block the antenna currents and may be transparent to radio-frequency electromagnetic signals. This may allow the antenna to exhibit satisfactory antenna efficiency (e.g., antenna efficiency similar to that of an antenna having a resonating element located in free space). For example, the openings in the second region may have a lateral surface area whereas the second region as a whole has a total lateral surface area. A ratio of the lateral surface area of the openings to the total lateral surface area of the second region (e.g., the so-called "etching ratio" of the second region) may be less than 20%, less than 10%, or between 0.1% and 10%, as examples. The conductive patches may have a maximal (greatest) lateral dimension that is between 0.1 and 5 mm. The openings may each have a width that is too narrow to be discerned by the un-aided human eye (e.g., less than 100 microns). This may, for example, allow the first and second regions of the conductive layer to appear to a user of the electronic device as a single continuous piece of conductor despite the fact that an antenna resonating element is formed therein.

DETAILED DESCRIPTION

Figure 1:
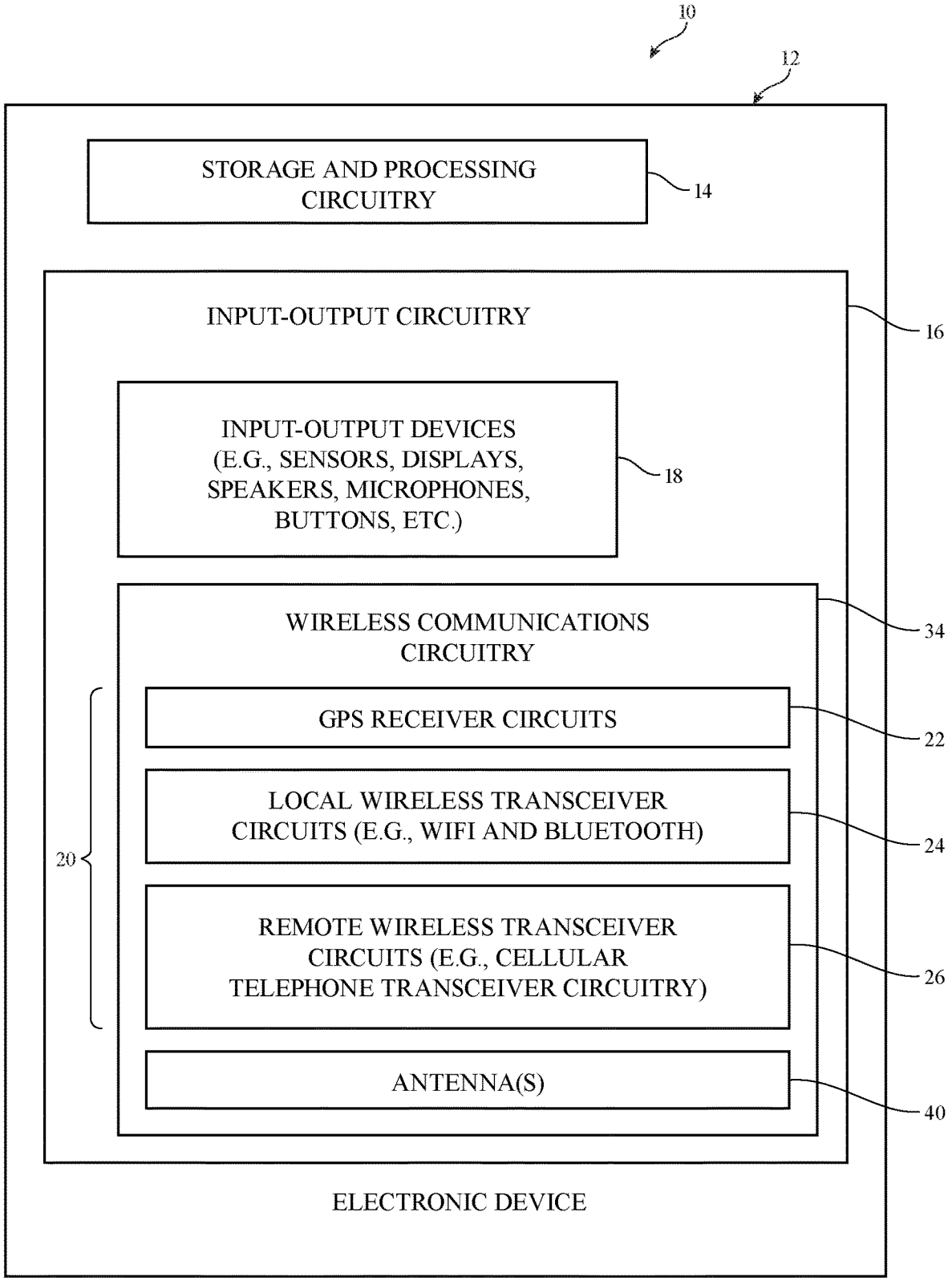
FIG. 1 is a schematic diagram of illustrative circuitry in an electronic device in accordance with an embodiment.

Electronic devices such as electronic device 10 of FIG. 1 may be provided with wireless communications circuitry. The wireless communications circuitry may be used to support wireless communications in one or more wireless communications bands.

The wireless communications circuitry may include one more antennas. The antennas of the wireless communications circuitry can include loop antennas, inverted-F antennas, strip antennas, planar inverted-F antennas, slot antennas, patch antennas, dipole antennas, monopole antennas, hybrid antennas that include antenna structures of more than one type, or other suitable antennas. The antennas may transmit and/or receive radio-frequency signals within one or more wireless communications bands. The wireless communications bands may, for example, include radio frequencies such as frequencies of 700 MHz or greater. Conductive structures for the antennas may, if desired, be formed from conductive electronic device structures.

The conductive electronic device structures may include conductive housing structures. As examples, the housing structures may include peripheral structures such as peripheral conductive structures that run around the periphery of an electronic device. The peripheral conductive structure may serve as a bezel for a planar structure such as a display, may serve as sidewall structures for a device housing, may have portions that extend upwards from an integral planar rear housing (e.g., to form vertical planar sidewalls or curved sidewalls), and/or may form other housing structures.

Antennas may be embedded within the conductive electronic device structures. A grid of slots or openings may be formed in the conductive electronic device structures to form a pattern or array of conductive patches that are separated by the slots. The slots may have a width such that the region of the conductive electronic device structures in which the slots are formed is transparent to radio-frequency signals. Such regions may sometimes be referred to herein as radio-frequency transparent patterned regions of the conductive electronic device structures. The slots may be sufficiently narrow so as to be invisible to the un-aided human eye (e.g., so that the radio-frequency transparent patterned region appears to the un-aided human eye as a single continuous piece of conductor).

The antennas may include antenna elements such as one or more antenna resonating elements and an antenna ground plane. The antenna resonating element may be formed from a continuous, un-patterned (slot-free) region of the conductive electronic device structures. Edges of the un-patterned region may be defined by the patterned region. Because the slots in the surrounding patterned region of the conductive electronic device structures are invisible to the un-aided eye, the antenna resonating element and the surrounding patterned region may appear to the un-aided eye as a single continuous piece of conductor. Because the patterned region is transparent at radio frequencies (e.g., the patterned region interacts with electromagnetic waves similar to free space at radio frequencies), the antenna resonating element may operate normally (e.g., with satisfactory antenna efficiency) at radio-frequencies without shorting antenna currents to surrounding conductive electronic device structures.

Electronic device 10 may be a computing device such as a laptop computer, a computer monitor containing an embedded computer, a tablet computer, a cellular telephone, a media player, or other handheld or portable electronic device, a smaller device such as a wristwatch device, a pendant device, a headphone or earpiece device, a virtual or augmented reality headset device, a device embedded in eyeglasses or other equipment worn on a user's head, or other wearable or miniature device, a television, a computer display that does not contain an embedded computer, a gaming device, a navigation device, an embedded system such as a system in which electronic equipment is mounted in a kiosk, building, vehicle, or automobile, a wireless access point or base station, a desktop computer, a keyboard, a gaming controller, a computer mouse, a mousepad, a trackpad or touchpad device, equipment that implements the functionality of two or more of these devices, or other electronic equipment. Other configurations may be used for device 10 if desired. The example of FIG. 1 is merely illustrative.

If desired, device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

FIG. 1 is a schematic diagram showing illustrative components that may be used in device 10. As shown in FIG. 1, device 10 may include control circuitry such as storage and processing circuitry 14. Storage and processing circuitry 14 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 14 may be used to control the operation of device 10. This processing circuitry may be based on one or more microprocessors, microcontrollers, digital signal processors, application specific integrated circuits, etc.

Storage and processing circuitry 14 may be used to run software on device 10, such as internet browsing applications, voice-over-internet-protocol (VOIP) telephone call applications, email applications, media playback applications, operating system functions, etc. To support interactions with external equipment, storage and processing circuitry 14 may be used in implementing communications protocols. Communications protocols that may be implemented using storage and processing circuitry 14 include internet protocols, wireless local area network protocols (e.g., IEEE 802.11 protocols—sometimes referred to as WiFi®), protocols for other short-range wireless communications links such as the Bluetooth® protocol, cellular telephone protocols, multiple-input and multiple-output (MIMO) protocols, antenna diversity protocols, etc.

Input-output circuitry 16 may include input-output devices 18. Input-output devices 18 may be used to allow data to be supplied to device 10 and to allow data to be provided from device 10 to external devices. Input-output devices 18 may include user interface devices, data port devices, and other input-output components. For example, input-output devices 18 may include touch screens, displays without touch sensor capabilities, buttons, joysticks, scrolling wheels, touch pads, key pads, keyboards, microphones, cameras, buttons, speakers, status indicators, light sources, audio jacks and other audio port components, digital data port devices, light sensors, motion sensors (accelerometers), capacitance sensors, proximity sensors, fingerprint sensors (e.g., a fingerprint sensor integrated with a button), etc.

Input-output circuitry 16 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 20 for handling various radio-frequency communications bands. For example, circuitry 34 may include transceiver circuitry 22, 24, and/or 26. Transceiver circuitry 24 may handle 2.4 GHz and 5 GHz bands for WiFi® (IEEE 802.11) communications and may handle the 2.4 GHz Bluetooth® communications band. Circuitry 34 may use cellular telephone transceiver circuitry 26 for handling wireless communications in frequency ranges such as a low communications band from 700 to 960 MHz, a low-midband from 1400-1520 MHz, a midband from 1710 to 2170 MHz, and a high band from 2300 to 2700 MHz or other communications bands between 700 MHz and 4000 MHz or other suitable frequencies (as examples). Circuitry 26 may handle voice data and non-voice data. Wireless communications circuitry 34 can include circuitry for other short-range and long-range wireless links if desired. For example, wireless communications circuitry 34 may include millimeter wave (e.g., 60 GHz) transceiver circuitry, circuitry for receiving television and radio signals, paging system transceivers, near field communications (NFC) circuitry, etc.

Wireless communications circuitry 34 may include global positioning system (GPS) receiver equipment such as GPS receiver circuitry 22 for receiving GPS signals at 1575 MHz or for handling other satellite positioning data (e.g., GLONASS signals at 1609 MHz). Satellite navigation system signals for receiver 22 are received from a constellation of satellites orbiting the earth. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include one or more antennas 40. Antennas 40 may be formed using any suitable antenna types. For example, antennas 40 may include antennas with resonating elements that are formed from loop antenna structures, patch antenna structures, dipole antenna structures, monopole antenna structures, inverted-F antenna structures, slot antenna structures, planar inverted-F antenna structures, helical antenna structures, hybrids of these designs, etc. Different types of antennas may be used for different bands and combinations of bands. For example, one type of antenna may be used in forming a local wireless link antenna and another type of antenna may be used in forming a remote wireless link antenna. If desired, two or more antennas 40 may be arranged in a phased antenna array that are operated using beam steering techniques (e.g., schemes in which antenna signal phase and/or magnitude for each antenna in an array is adjusted to perform beam steering). Antenna diversity schemes may also be used to ensure that antennas that have become blocked or that are otherwise degraded due to the operating environment of device 10 can be switched out of use and higher-performing antennas used in their place.

Figure 2:
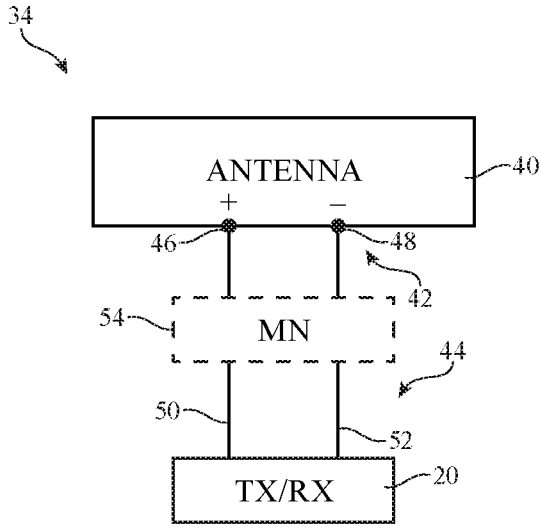
FIG. 2 is a diagram of an illustrative transceiver circuit and antenna in accordance with an embodiment.

As shown in FIG. 2, transceiver circuitry 20 in wireless circuitry 34 may be coupled to antenna feed 42 using radio-frequency transmission line 44. Antenna feed 42 may include a positive antenna feed terminal such as positive antenna feed terminal 46 and may include a ground antenna feed terminal such as ground antenna feed terminal 48. Transmission line 44 may be formed from metal traces on a printed circuit or other conductive structures and may have a positive transmission line signal path such as path 50 that is coupled to terminal 46 and a ground transmission line signal path such as path 52 that is coupled to terminal 48. Other types of antenna feed arrangements may be used if desired. For example, antenna structures 40 may be fed using multiple feeds. The illustrative feeding configuration of FIG. 2 is merely illustrative.

Transmission line paths such as path 44 may be used to route antenna signals within device 10. Transmission line 44 may include coaxial cable paths, microstrip transmission lines, stripline transmission lines, edge-coupled microstrip transmission lines, edge-coupled stripline transmission lines, transmission lines formed from combinations of transmission lines of these types, or any other desired radio-frequency transmission line structures. Filter circuitry, switching circuitry, impedance matching circuitry, and other circuitry may be coupled to antenna 40 (e.g., to support antenna tuning, to support operation in desired frequency bands, etc.).

If desired, optional impedance matching circuitry 54 may be interposed on path 44. Impedance matching circuitry 54 may include fixed and/or tunable components. For example, circuitry 54 may include a tunable impedance matching network formed from components such as inductors, resistors, and capacitors that are used in matching the impedance of antenna structures 40 to the impedance of transmission line 44. If desired, circuitry 54 may include a band pass filter, band stop filter, high pass filter, and/or low pass filter. Components in matching circuitry 54 may be provided as discrete components (e.g., surface mount technology components) or may be formed from housing structures, printed circuit board structures, traces on plastic supports, etc. In scenarios where matching circuitry 54 is adjustable, control circuitry 14 may provide control signals that adjust the impedance provided by matching circuitry 54, for example. Matching network 54 and/or other tunable components coupled to antenna 40 may be adjusted (e.g., using control signals provided by control circuitry 14) to cover different desired communications bands.

Figure 3:
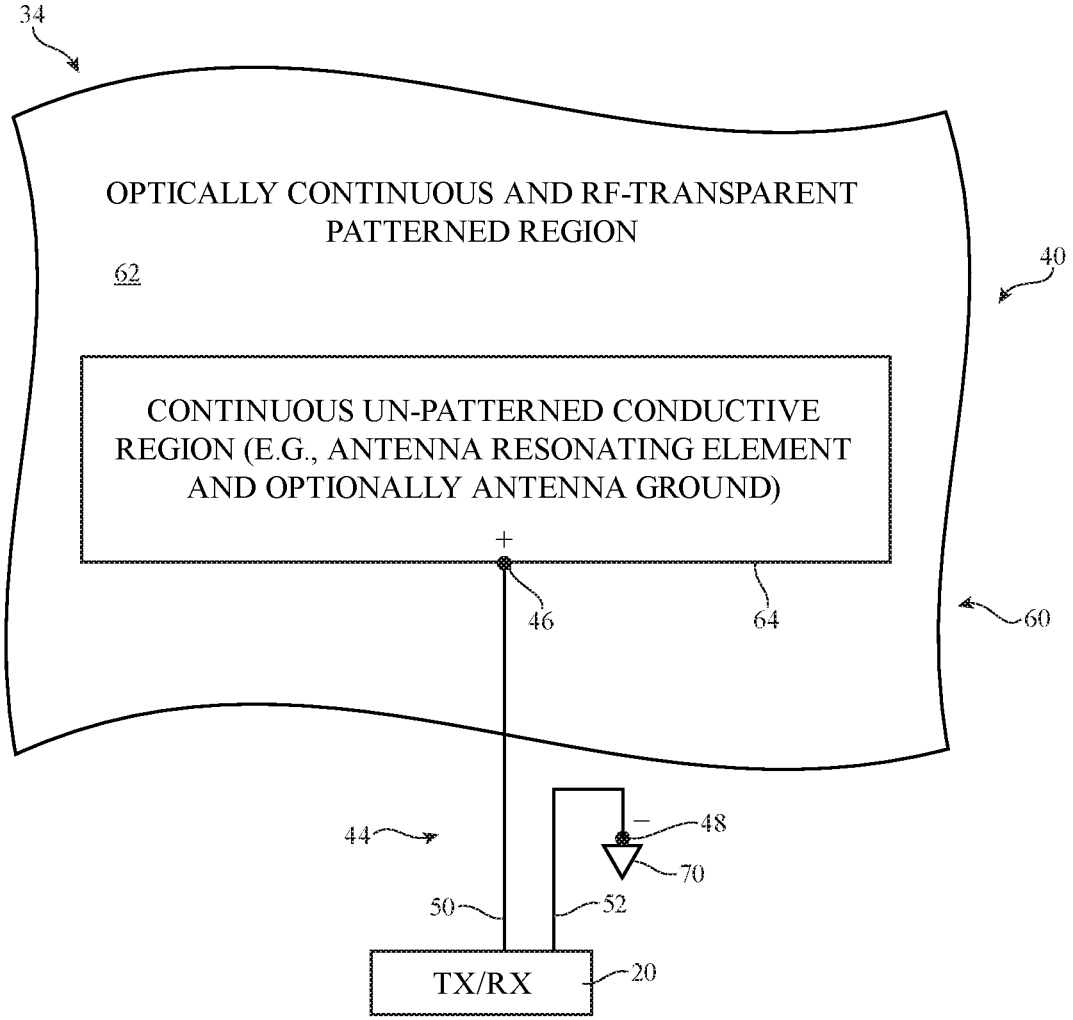
FIG. 3 is a diagram of an antenna formed from a conductive layer having radio-frequency transparent patterned regions in accordance with an embodiment.

If care is not taken, the presence of conductive structures such as conductive housing structures can influence the performance of antenna 40. Antenna performance may not be satisfactory if the housing structures are not configured properly and interfere with (e.g., electromagnetically shield or block) antenna operation. FIG. 3 is a diagram showing how antenna 40 may be formed using conductive structures within device 10.

As shown in FIG. 3, electronic device 10 may include a conductive device structure such as conductive layer 60. If desired, conductive layer 60 may be formed on a dielectric substrate. Conductive layer 60 may include a metal trace, metal foil, stamped sheet metal, a conductive coating on the dielectric substrate, a conductive portion of housing 12

(FIG. 1), or any other desired conductive structure. Conductive layer 60 may include, for example, copper, aluminum, stainless steel, silver, gold, nickel, tin, other metals or metal alloys, or any other desired conductive materials.

Conductive layer 60 may be patterned to form a radio-frequency transparent region such as region 62 and a continuous region such as region 64. Slots or openings may be formed in conductive layer 60 within region 62. The slots in region 62 may be arranged in a grid pattern, for example. The slots in region 62 may for example, extend completely through the thickness of conductive layer 62 and may divide conductive layer 60 into a pattern or array of conductive patches within region 62. Continuous region 64 may be formed from a single continuous portion of conductive layer 60 (e.g., region 64 may be formed from a solid portion of conductive layer 60 that is free from slots or openings). Region 62 may therefore sometimes be referred to herein as patterned region 62 whereas region 64 is sometimes referred to herein as un-patterned region 64.

Each of the conductive patches in patterned region 62 may be separated from other conductive patches in patterned region 62 by a corresponding slot in conductive layer 60. Patterned region 62 may surround some or all of un-patterned region 64 (e.g., at least one edge or at least part of the outline of un-patterned region 64 may be defined by patterned region 62). For example, one or more of the slots within patterned region 62 may define the shape (e.g., the edges or outline) of un-patterned region 64 within conductive layer 60.

If care is not taken, conductive structures such as metal may block or otherwise interfere with the transmission or reception of radio-frequency signals by antenna 40. The slots in patterned region 62 of conductive layer 60 may configure patterned region 62 to be transparent to radio-frequency electromagnetic signals (e.g., so that radio-frequency signals pass through patterned region 62 without being blocked by conductive layer 60). For example, the dimensions, shapes, and arrangement of the slots and the conductive patches within patterned region 62 may be selected to allow radio-frequency signals to freely pass through conductive layer 60 without being blocked. In contrast, continuous metal structures such as un-patterned region 64 of conductive layer 60 may be opaque to radio-frequency signals. Patterned region 62 may sometimes be referred to herein as radio-frequency transparent region 62 or radio-frequency transparent patterned region 62 of conductive layer 60. Un-patterned region 64 may sometimes be referred to herein as continuous region 64 or solid region 64 of conductive layer 60.

Antenna 40 may include antenna elements such as an antenna resonating element, an antenna ground, and antenna feed 42. The antenna resonating element may be coupled to positive antenna feed terminal 46 whereas the antenna ground is coupled to ground antenna feed terminal 48. The antenna resonating element may have dimensions (e.g., a particular shape, perimeter, and/or area) that support an antenna resonance within one or more desired frequency bands (e.g., for performing wireless communications in those frequency bands).

As shown in FIG. 3, positive antenna feed terminal 46 may be coupled to conductive layer 60 within un-patterned region 64 so that un-patterned region 64 of conductive layer 60 forms the antenna resonating element for antenna 40. Ground antenna feed terminal 48 of antenna 40 may be coupled to antenna ground 70. Antenna ground 70 may include conductive portions of housing 12, conductive layers on a substrate such as a printed circuit board, conductive components within device 10, or any other desired conductive components. If desired, antenna ground 70 may be formed from one or more un-patterned regions 64 of conductive layer 60.

Un-patterned region 64 of conductive layer 60 may receive radio-frequency signals from transceiver circuitry 20 over positive feed terminal 46. Corresponding antenna currents may flow through un-patterned region 64. Patterned region 62 of conductive layer 60 may form an open circuit at radio-frequencies so that the antenna currents do not flow over patterned region 62 (e.g., patterned region 62 may block the antenna currents from flowing into region 62). Antenna currents flowing through un-patterned region 64 and antenna ground 70 may generate wireless signals that are radiated by antenna 40. Because patterned region 62 is transparent to radio-frequency signals, patterned region 62 interacts with the wireless signals similar to free space, and the wireless signals may be freely radiated from antenna 40 to external communications equipment. Similarly, antenna 40 may receive wireless signals from external communications equipment. The received wireless signals may generate antenna currents on un-patterned region 64 and antenna ground 70 that are then conveyed to transceiver 20 over transmission line 44. If region 62 were not transparent to radio-frequency signals, antenna 40 would exhibit an unsatisfactory (degraded) antenna efficiency (e.g., because the antenna currents would be shorted to the entirety of conductive layer 60). By forming antenna 40 using a continuous region 64 defined by patterned region 62 of conductive layer 60, antenna 40 may freely transmit and receive radio-frequency signals with satisfactory antenna efficiency (e.g., antenna efficiency comparable to that of an antenna having an antenna resonating element formed in a free space environment).

If desired, the dimensions and shape of the slots and the corresponding conductive patches within patterned region 62 of conductive layer 60 may be selected so that the slots are invisible or indiscernible to the unaided human eye. For example, the slots may be narrower than is resolvable to the unaided human eye at a predetermined distance from conductive layer 60 (e.g., a distance of 1 meter, 1 centimeter, 10 centimeters, etc.). This may allow the entirety of patterned region 62 and un-patterned region 64 to appear to a user as a single continuous (solid) piece of metal, thereby obscuring the potentially unsightly antenna 40 from the user's view. This may serve to enhance the aesthetic properties of conductive layer 60 to the user (particularly in scenarios where conductive layer 60 is formed at the exterior of device 10, for example).

As an example, the optical characteristics of regions 62 and 64 of conductive layer 60 may be characterized by the reflectivity, absorption, and transmission of visible light by regions 62 and 64. Region 62 may exhibit a first reflectivity, first absorptivity, and first transmissivity, whereas region 64 exhibits a second reflectivity, second absorptivity, and second transmissivity for visible light. In order to appear to the unaided eye as a single continuous piece of conductor, region 62 may have a first reflectivity, first absorptivity, and/or first transmissivity that are within a predetermined margin of the second reflectivity, second absorptivity, and/or second transmissivity associated with region 64, respectively (e.g., within a margin of 10%, 20%, 10-20%, 20-30%, 5%, 2%, 1-10%, etc.).

The example of FIG. 3 is merely illustrative. If desired, multiple un-patterned regions such as region 64 may be formed within conductive layer 60. Each of the un-patterned regions in conductive layer 60 may be separated by some or all of patterned region 62. Antenna 40 may include multiple resonating elements formed from different un-patterned regions in conductive layer 60 if desired. In another suitable arrangement, multiple antennas 40 may be formed using different un-patterned regions in conductive layer 60.

Figure 4:
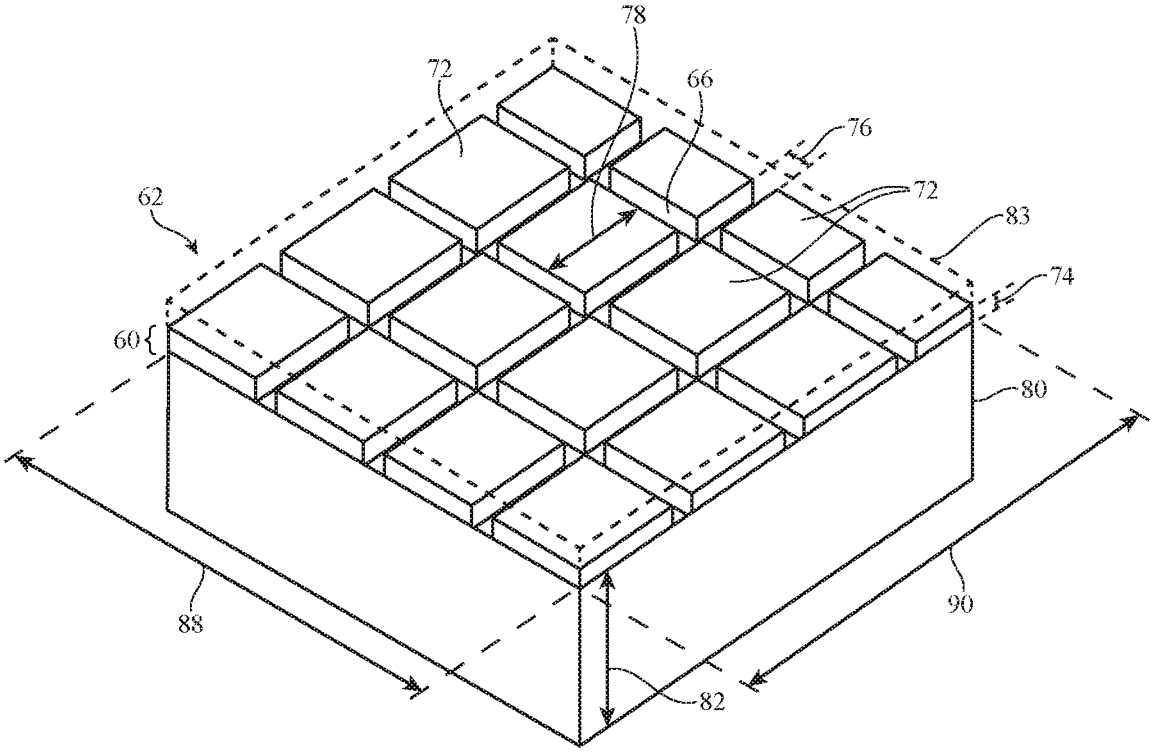
FIG. 4 is a perspective view of a radio-frequency transparent region of a conductive layer having a pattern of rectangular patches in accordance with an embodiment.

FIG. 4 is a perspective view showing patterned region 62 of conductive layer 60. As shown in FIG. 4, conductive layer 60 may be formed on a substrate such as dielectric substrate 80. Substrate 80 may be formed from plastic, polymer, glass, ceramic, epoxy, foam, a rigid or flexible printed circuit board substrate, or any other desired materials. Conductive layer 60 may include a conductive coating or metal coating, sheet metal, conductive or metal traces, or any other desired conductive structures formed on a surface of substrate 80. Substrate 80 may have a thickness (height) 82. Conductive layer 60 may have a thickness (height) 74. Thickness 82 of substrate 80 may be, for example, between 6 mm and 1 mm, between 5.5 mm and 2 mm, between 5 mm and 3 mm, less than 1 mm, between 0.1 mm and 2 mm, or greater than 6 mm (e.g., 1 cm, 5 cm, 10 cm, etc.). Thickness 74 of conductive layer 60 may be, for example, between 100 nm and 10 nm, between 75 nm and 25 nm, less than 25 nm, greater than 100 nm, between 0.1 mm and 0.5 mm, between 500 microns and 1 mm, between 1 and 500 microns, or greater than 1 mm. In practice, lesser thicknesses 74 may provide region 62 of layer 60 with a greater amount of radio-frequency transparency than when greater thicknesses 74 are used, whereas lesser thicknesses 74 may increase the difficulty of manufacturing layer 60 relative to when greater thicknesses 74 are used, for example.

As shown in FIG. 4, a grid of slots such as slots 66 may be formed in conductive layer 60 within patterned region 62. As examples, slots 66 may be formed in conductive layer 60 by etching (e.g., laser etching), stripping, cutting, or otherwise removing conductive material in layer 60 from the surface of substrate 80, or may be formed upon deposition of conductive layer 60 onto the surface of substrate 80. Slots 66 (sometimes referred to as gaps, notches, or openings) may extend through thickness 74 of conductive layer 60, thereby exposing substrate 80 through layer 60. If desired, slots 66 may be filled with a dielectric material such as plastic, glass, ceramic, epoxy, adhesive, integral portions of substrate 80, or other dielectric materials. If desired, slots 66 may be filled with air. In another suitable arrangement, slots 66 may be formed from integral portions of conductive layer 60 that have been processed to no longer be conductive (e.g., using oxidation or other processing techniques). In yet another suitable arrangement, slots 66 may extend only partially through the thickness 74 of layer 60 (e.g., some of the conductive material in layer 60 may remain within slots 66 if desired).

In the example of FIG. 4, slots 66 are formed within layer 60 in a rectangular grid pattern in which slots 66 divide conductive layer 60 into multiple rectangular conductive patches 72 (e.g., the edges of conductive patches 72 may be defined by slots 66). If desired, conductive patches 72 may be arranged in an array having aligned rows and columns. In another suitable arrangement, the rows and/or columns of patches 72 in the array may be misaligned (e.g., the even numbered rows or columns of patches 72 may all be aligned with each other whereas the odd numbered rows or columns of patches 72 are all aligned with each other but misaligned with respect to the even numbered rows and columns). Each of the rectangular patches 72 in patterned region 62 may be separated from other rectangular patches 72 and/or from un-patterned portions 64 of layer 60 (FIG. 3) by a corresponding segment of slots 66. Conductive patches 72 may sometimes be referred to herein as conductive tiles.

Patterned region 62 of conductive layer 60 may be defined at least in part by two characteristics: the length 78 of each segment of slots 66 (e.g., the portion of slots 66 separating two adjacent patches 72) and the width 76 of each segment of slots 66. The size of each rectangular (e.g., square) patch 72 may be dependent upon the length 78 and width 76 of each segment of the slots 66, for example. Each rectangular patch 72 within region 62 may have the same size and dimensions or two or more patches 72 within region 62 may have different sizes or dimensions. Each segment of slots 66 in region 62 may have the same length 78 and width 76 or two or more segments of slots 66 may have different lengths and/or widths.

The so-called "gap ratio," "slot ratio," or "etching ratio" of region 62 may be defined as the ratio of the lateral surface area of slots 66 within patterned region 62 to the total lateral surface area of patterned region 62 (i.e., the total lateral surface area of patterned region 62 includes the lateral surface area of slots 66 within region 62). In the example of FIG. 4, the total lateral surface area of region 62 is equal to the product of dimension 88 and dimension 90 (e.g., the sum total of area covered by all of slots 66 and patches 72 in region 62). Similarly, the lateral surface area of slots 66 is equal to the product of slot length 78 to slot width 76 times the total number of slot segments in region 62 (adjusting for overlap between each of the segments).

As examples, a gap ratio of 0.0 (i.e., 0%) may correspond to a region of conductive layer 60 in which no slots 66 are formed (e.g., un-patterned region 64 of FIG. 3), whereas a gap ratio of 1.0 (i.e., 100%) may correspond to a region in which all of the conductive material has been removed from layer 60. In other words, as length 78 and width 76 of slots 66 increase or the dimensions of patches 72 decrease, the gap ratio of region 62 increases.

In practice, the gap ratio may affect the amount of radio-frequency signals transmitted through region 62 of layer 60 (e.g., the degree to which region 62 is transparent at radio-frequencies or, in other words, the radio-frequency transmissivity of region 62). In general, larger gap ratios may increase the radio-frequency transparency of layer 60 while also increasing the visibility of gaps 66 to a user relative to scenarios where smaller gap ratios are used. In order to allow for region 62 to have satisfactory radio-frequency transparency while still appearing as a continuous conductor to a user, patterned region 62 may be formed with a gap ratio selected between 0.1% and 10%, between 0.5% and 5%, less than 20%, between 10% and 20%, or between 1% and 3%, as examples. In order to allow for optimal antenna efficiency, slots 66 may have segment lengths 78 (patches 72 may have widths) that are less than 5 mm and greater than 0.1 mm, for example (e.g., lengths 78 may be between 0.1 and 1 mm, between 1 and 5 mm, between 0.2 and 0.5 mm, etc.). In another suitable arrangement, the greatest (maximum or longest) lateral dimension of patches 72 (e.g., the corner-to-corner length of rectangular patches 72) may be between 0.1 mm and 5 mm. The dimensions of patches 72, thickness 74, lengths 78, widths 76, and/or the particular frequency of operation may affect the radio-frequency transparency of region 62 and thus the efficiency of antenna 40 formed using conductive layer 60.

In order for slots 66 to remain invisible or indiscernible to the un-aided human eye at a predetermined distance (e.g., for region 62 to appear as a continuous piece of conductor), slots 66 may have a width 76 that is less than or equal to the resolving power of the un-aided human eye at the predetermined distance. For example, slots 66 may have widths 76 that are less than 200 microns or less than 100 microns such as a width of 50 microns, 40 microns, 70 microns, between 50 and 70 microns, between 70 and 100 microns, between 20 and 50 microns, between 2 and 5 microns, between 10 and 20 microns, between 1 and 10 microns, less than 1 micron, etc.

When configured in this way, patterned region 62 of conductive layer 60 may exhibit a visible light reflectivity, absorptivity, and/or transmissivity that are within 20%, within 10%, within less than 10% (e.g., within 5%, within 2%, etc.), or within 10-20% of the visible light reflectivity, absorptivity, and/or transmissivity of un-patterned region 64 of conductive layer 60, as examples. Patterned region 62 and un-patterned region 64 of conductive layer 60 may thereby appear to the user of device 10 as a single continuous piece of metal.

If desired, optional protective cover layer 83 may be formed over conductive layer 60 (e.g., on a side of layer 60 opposite to substrate 80). Protective cover layer 83 may include, for example, a dielectric or polymer coating. Cover layer 83 may mechanically protect layer 60 (e.g., to prevent a user from being able to damage portions of layer 60) and/or may protect layer 60 from dust, oils, or other contaminants. If desired, substrate 80 and/or cover layer 83 may be omitted. In this scenario, dielectric adhesive may be formed within slots 66 to bind patches 72 together, for example.

Figure 5:
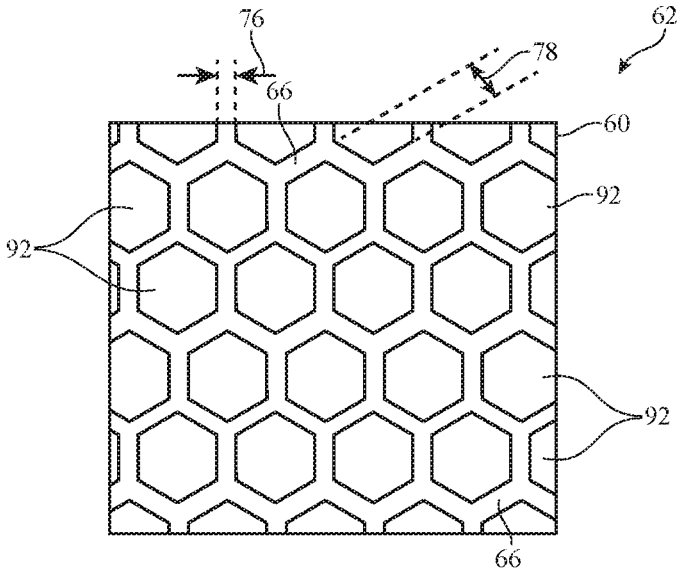
FIG. 5 is a top-down view of a radio-frequency transparent region of a conductive layer having a pattern of hexagonal patches in accordance with an embodiment.

The example of FIG. 4 in which a grid of slots 66 divide conductive layer 60 into an array of rectangular patches 72 is merely illustrative. If desired, slots 66 may divide conductive layer 60 into conductive patches of any desired shape. FIG. 5 is a top-down view of patterned region 62 in which slots 66 divide conductive layer 60 into an array of hexagonal conductive patches.

As shown in FIG. 5, each segment of slots 66 in conductive layer 60 may separate two adjacent hexagonal (i.e., six-sided) conductive patches 92 (or may separate patches 92 from an un-patterned region 64 of layer 60). In other words, each slot segment may be formed between a corresponding side of two different, adjacent hexagonal patches 92. Each segment of slots 66 may have slot width 76 and length 78 (e.g., each side of hexagonal patches 92 may have a length equal to length 78). Forming region 62 using a hexagonal grid of slots 66 and hexagonal conductive patches 92 may allow for increased antenna efficiency for certain types of antenna resonating elements (i.e., antenna resonating elements formed from un-patterned regions 64) relative to the rectangular pattern shown in FIG. 4, for example. Each hexagonal patch 92 may have the same size and dimensions within region 62 or two or more patches 92 within region 62 may have different sizes or dimensions. Each side of patches 92 or the maximal lateral dimension of each patch 92 may be, for example, between 0.1 mm and 5 mm.

Figure 6:
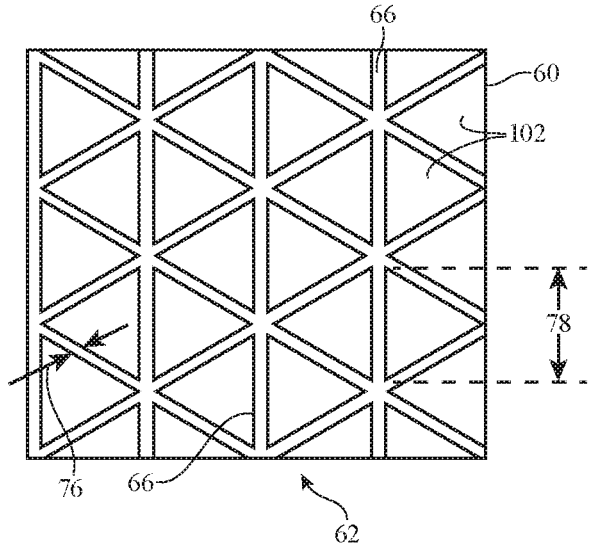
FIG. 6 is a top-down view of a radio-frequency transparent region of a conductive layer having a pattern of triangular patches in accordance with an embodiment.

FIG. 6 is a top-down view of patterned region 62 in which a grid of slots 66 divide conductive layer 60 into an array of triangular patches. As shown in FIG. 6, each segment of slots 66 in conductive layer 60 may separate two adjacent triangular (i.e., three-sided) conductive patches 102 (or may separate patches 102 from an un-patterned region 64 of layer 60). In other words, each slot segment may be formed between a corresponding side of two different, adjacent triangular patches 102. Triangular patches 102 may be, for example, equilateral triangles. Each segment of slots 66 may have slot width 76 and length 78 (e.g., each side of triangular patches 102 may have a length equal to length 78). Each side of triangular patches 102 or the maximal lateral dimension of each triangular patch 102 may be, for example, between 0.1 mm and 5 mm. Forming region 62 using a triangular grid of slots 66 and triangular conductive patches 102 may allow for increased antenna efficiency for certain types of antenna resonating elements relative to the square pattern shown in FIG. 5 and the hexagonal pattern shown in FIG. 5, for example.

Figure 7:
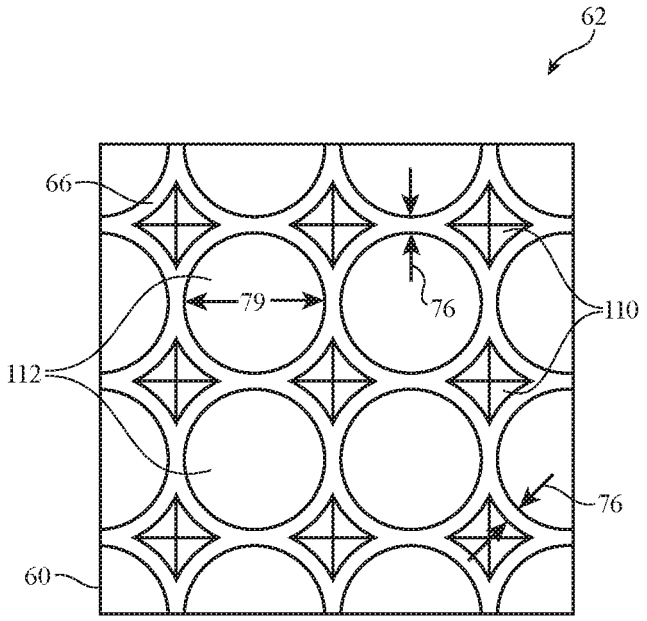
FIGS. 7 and 8 are top-down views of a radio-frequency transparent region of a conductive layer having a pattern of round patches in accordance with an embodiment.
Figure 8:
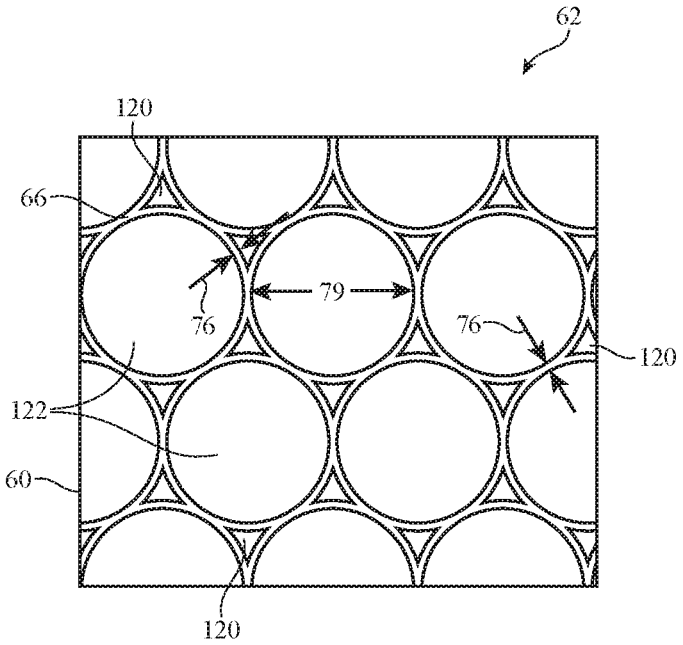

In the example of FIGS. 4-6, each of the conductive patches in patterned region 62 has the same equilateral shape (e.g., each of the sides of each conductive patch is straight and the same length). This is merely illustrative. If desired, patterned region 62 may include different conductive patches having different shapes as defined by curved and/or straight edges. FIGS. 7 and 8 are top-down views of patterned region 62 in which slots 66 form a pattern of conductive patches of different shapes and having curved and/or straight edges.

As shown in FIG. 7, slots 66 may divide conductive layer 60 into an array of rounded conductive patches 112 and 110 in conductive layer 60. In this example, slots 66 my follow curved paths (may have curved shapes) and may separate each rounded patch 112 from adjacent patches 112 and 110 in region 62. Rounded patches 112 may be, for example, elliptical or circular patches having a diameter (e.g., maximal lateral dimension) 79. Dimension 79 may be between 0.1 mm and 5 mm, for example. Rounded patches 110 may be, for example, diamond-shaped patches having curved sides (e.g., sides having a radius of curvature equal to the radius of curvature of patches 110). Slots 66 may have width 76 throughout region 62. In the example of FIG. 7, the array of conductive patches 112 and 110 may include a first sub-array (set) of patches 112 and a second sub-array (set) of patches 110. The sub-array of patches 112 may be arranged in aligned rows and columns. Similarly, the sub-array of patches 110 may be arranged in aligned rows and columns. The rows and columns of the sub-array of patches 110 may be offset (e.g., misaligned) with respect to the sub-array of patches 112. This may, for example, ensure that slots 66 maintain width 76 (e.g., to ensure that region 62 remains radio-frequency transparent and visibly continuous) throughout region 62.

In the example of FIG. 7, the sub-array of rounded patches 112 is arranged in aligned rows and columns. In another suitable arrangement, rounded patches 112 may be located in rows where each patch is misaligned with the patches in the previous and subsequent rows, as shown in FIG. 8. In the example of FIG. 8, slots 66 divide conductive layer 60 into an array of rounded patches 122 in region 62. The patches 122 in the odd rows of the array may be aligned with each other but misaligned from the patches in the even rows of the array. Each rounded patch 122 may have a diameter 79 (e.g., a maximal lateral dimension between 0.1 mm and 5 mm). In order to ensure that slots 66 maintain width 76 throughout region 62 (e.g., to ensure that region 62 remains radio-frequency transparent and visibly opaque), intervening conductive patches 120 may be formed between every three adjacent rounded patches 122 in the pattern.

The examples of FIGS. 4-8 are merely illustrative. In general, slots 66 may divide conductive layer 60 into conductive patches having any desired shapes, sizes, and dimensions (e.g., slots 66 may define conductive patches having pentagon shapes, octagon shapes, other polygonal shapes, shapes having curved and straight edges, etc.). Different sets of conductive patches of different sizes, shapes, and dimensions may be formed within the same patterned region 62 if desired. For example, one or more of the patterns shown in FIGS. 4-8 may each be used in the same patterned region 62 and/or may be combined with other patterns. In general, in order to allow patterned region 62 to appear to the un-aided eye as continuous with un-patterned region 64 while optimizing antenna efficiency, slots 66 within patterned region 62 may have a width 76 throughout region 62 that is less than or equal to 100 microns regardless of the specific patch shape and arrangement that is used, for example (e.g., slots 66 may have a width of 100 microns, 50 microns, 70 microns, between 50 and 70 microns, between 70 and 100 microns, between 20 and 50 microns, between 2 and 5 microns, between 10 and 20 microns, between 1 and 10 microns, less than 1 micron, etc.). Similarly, in order to allow for optimal radio-frequency transparency and antenna efficiency, the gap ratio of patterned region 62 may be the same (e.g., less than 20%, less than 10%, between 0.1% and 10%, between 0.5% and 5%, between 1% and 3%, etc.) regardless of the specific patch shape and arrangement that is used. Different conductive patch patterns and arrangements may be more optimal for antenna efficiency and for contributing to the seamless appearance of conductive layer 70 for some types of antennas than other patch patterns and arrangements, for example.

Figure 9:
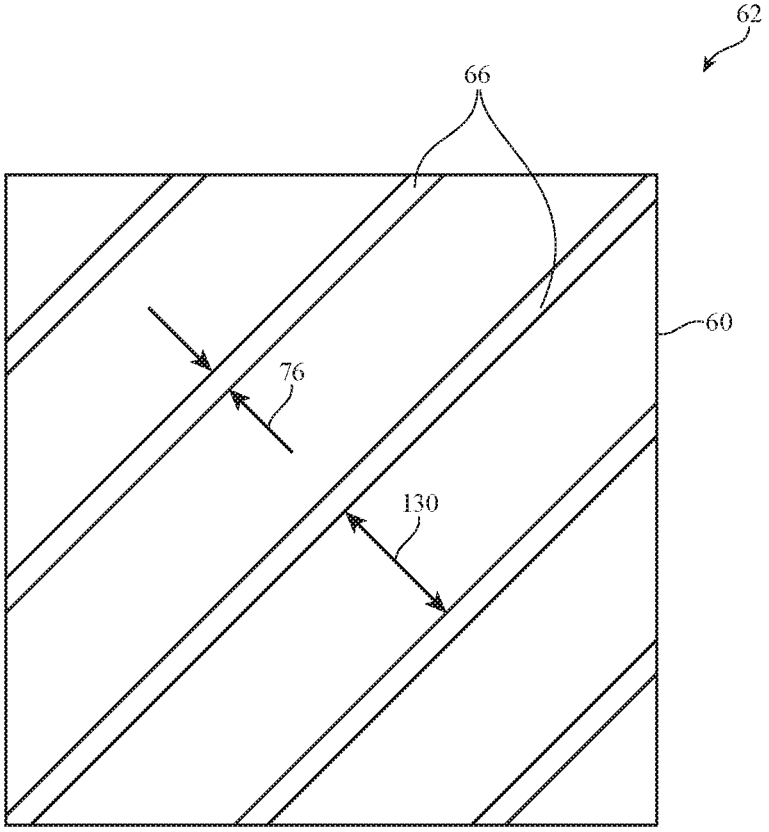
FIG. 9 is a top-down view of a radio-frequency transparent region of a conductive layer having a pattern of linearly polarizing slots in accordance with an embodiment.

If desired, slots 66 may be configured to affect the polarization of electromagnetic signals conveyed using antenna 40. FIG. 9 is a top-down view of patterned region 62 in which slots 66 form a linear polarizer for antenna 40. As shown in FIG. 9, slots 66 are formed from a pattern of multiple parallel slot segments in region 62. Each of slots 66 may have width 76 and may be separated from adjacent slots 66 by distance 130. Distance 130 may, for example, be approximately equal to dimension 79 of FIGS. 7 and 8 and/or dimension 78 of FIGS. 4-6 or may be any other desired distance. By forming slots 66 from multiple parallel segments, slots 66 may be transparent to radio-frequency signals of a particular polarization (e.g., linear polarization angle) and opaque to radio-frequency signals at other polarizations. The particular angle of slots 66 relative to un-patterned region 64 may determine the linear polarization angle of the radio-frequency signals that pass through region 62. Patterned region 62 having polarizing slots 66 may only transmit radio-frequency signals of the corresponding polarization. In this scenario, antenna 40 may have optimal antenna efficiency when conveying signals at the polarization of slots 66 and may have degraded antenna efficiency for other polarizations. In this way, slots 66 may be configured to allow antenna 40 to only handle radio-frequency signals of a particular polarization.

Figure 10:
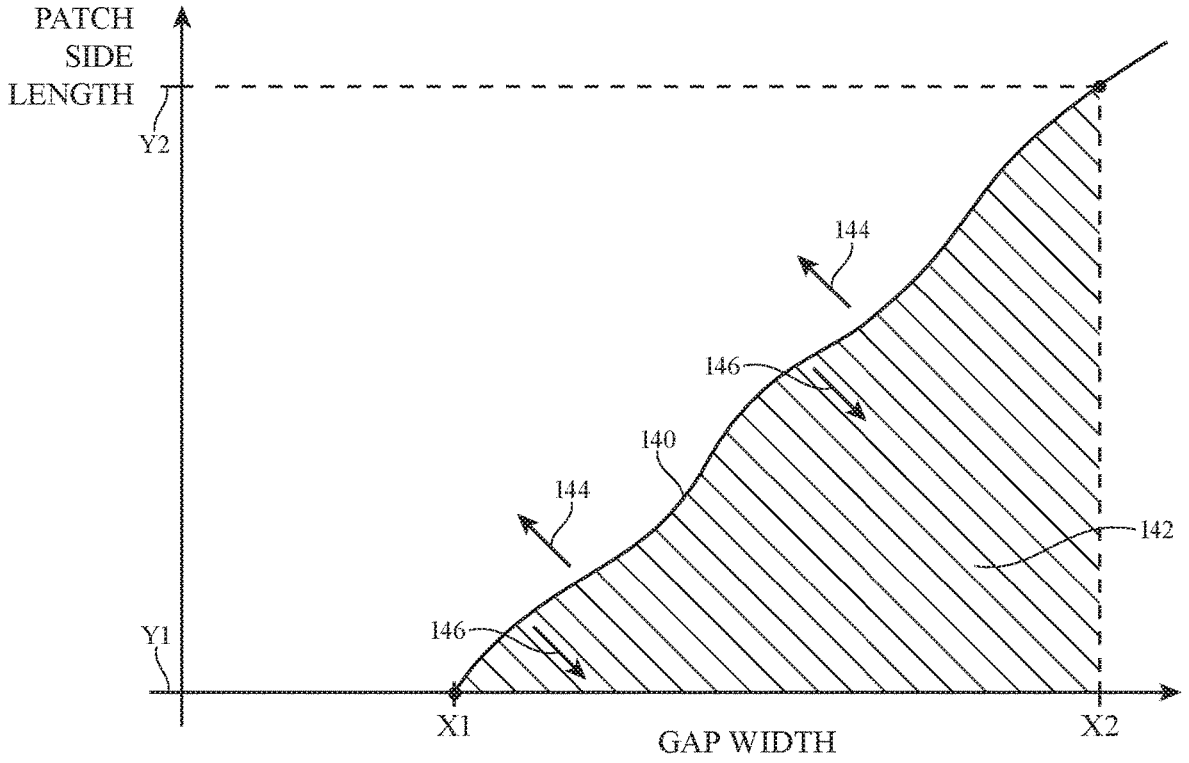
FIG. 10 is a plot of illustrative patch and slot dimensions for a radio-frequency transparent patterned region of a conductive layer in accordance with an embodiment.

FIG. 10 is a graph of possible dimensions for patterned region 62 (e.g., patterned region 62 as shown in FIGS. 4-9). As shown in FIG. 10, width 76 of slots 66 is plotted on the x-axis and the length of the conductive patches defined by slots 66 is plotted on the y-axis. The length of the conductive patches plotted on the y-axis may be, for example, distance 130 (FIG. 9), length 78 of FIGS. 4-6, length 79 of FIGS. 7 and 8, or the maximal lateral dimension of the conductive patches defined by slots 66.

Curve 140 may define a limit on possible dimensions for the length of the conductive patches given a corresponding width 76 of slots 66 (e.g., dimensions at which a minimum amount of plane wave transmission through layer 60 is obtained). The area 142 between curve 140 and minimum conductive patch length value Y1 and between minimum gap width value X1 and maximum gap width value X2 may represent the satisfactory dimensions for slots 66 and the corresponding conductive patches (e.g., dimensions for which patterned region 62 is sufficiently transparent and for which slots 66 are sufficiently invisible to the unaided eye). Maximum gap width value X2 may be, for example, the minimum resolvable distance for an un-aided human eye at a given distance from layer 60 (e.g., 100 microns). Widths 76 that are greater than value X2 may be discernable by the unaided eye and may thereby degrade the aesthetic quality of conductive layer 60 (e.g., such that the user will be able to discern un-patterned region 64 from patterned region 62). Minimum gap width value X1 may be, for example, the minimum width that still allows electromagnetic waves at the corresponding radio frequency to pass through region 62 (e.g., 1 micron, 2 microns, 5 microns, etc.). The length of the conductive patches within region 62 may be selected based on the width 76 of slots 66 to be used, so long as the length falls within region 140. Minimum length Y1 may be determined by limits in the manufacturing equipment used to form patterned region 62 or any other desired criteria. As an example, minimum length Y1 may be 0.1 mm, 0.2 mm, less than 0.1 mm, etc. Maximum length Y2 may be determined from the intersection of curve 140 with maximum gap width value X2. As an example, maximum length Y2 may be 5 mm, between 1 and 5 mm, 2 mm, 0.5 mm, less than 1 mm, between 5 and 10 mm, etc.

Threshold curve 140 may be determined through factory calibration and testing of antenna 40 within conductive layer 60, for example. In general the shape and location of curve 140 may depend upon the frequency of operation and on the thickness 74 of layer 60 (FIG. 4). In general, smaller thicknesses 74 may raise curve 140 as shown by arrows 144 (thereby reducing minimum width X1 and increasing maximum length Y2) whereas larger thicknesses 74 may lower curve 140 as shown by arrows 146 (thereby increasing minimum width X1 and decreasing maximum length Y2). Similarly, lower frequencies of operation may raise curve 140 as shown by arrows 144 whereas higher frequencies may lower curve 140 as shown by arrows 146. This example is merely illustrative.

Antenna 40 may be formed using any desired antenna structures. Antenna 40 may include an antenna resonating element formed from un-patterned region 64 within conductive layer 60 (FIG. 3). For example, antenna 40 may include a resonating element that is formed from loop antenna structures, patch antenna structures, dipole antenna structures, monopole antenna structures, inverted-F antenna structures, slot antenna structures, planar inverted-F antenna structures, helical antenna structures, hybrids of these designs, etc.

Figure 11:
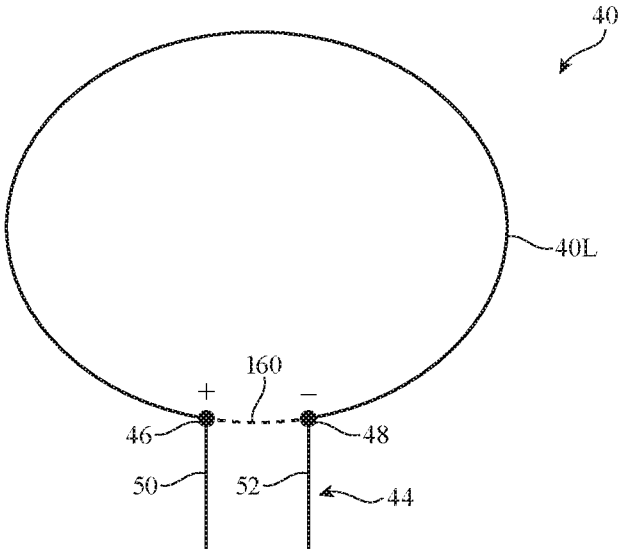
FIG. 11 is a schematic diagram of an illustrative loop antenna that may be used in an electronic device in accordance with an embodiment.

FIG. 11 is a schematic diagram showing how antenna 40 may be formed using loop antenna structures. As shown in FIG. 11, antenna 40 may include a loop antenna resonating element 40L that follows a loop-shaped conductive path. Positive transmission line conductor 50 and ground transmission line conductor 52 of transmission line 44 may be coupled to antenna feed terminals 46 and 48, respectively. Antenna currents may flow between feed terminals 46 and 48 over the loop-shaped conductive path of antenna resonating element 40L. The resonant frequency of antenna resonating element 40L may be inversely proportional to the total length or the enclosed area of antenna resonating element 40L, for example.

The example of FIG. 11 is merely illustrative. If desired, an optional electrical component 160 may bridge terminals 46 and 48, thereby "closing" the loop formed by the path of element 40L. Antenna 40 may sometimes be referred to as a series-fed loop antenna in the absence of electrical component 160 and may sometimes be referred to as a parallel-fed loop antenna in the presence of electrical component 160. Loop antenna resonating element 40L may have other shapes if desired (e.g., rectangular shapes, elliptical shapes, shapes with both curved and straight sides, shapes with irregular borders, etc.).

Figure 12:
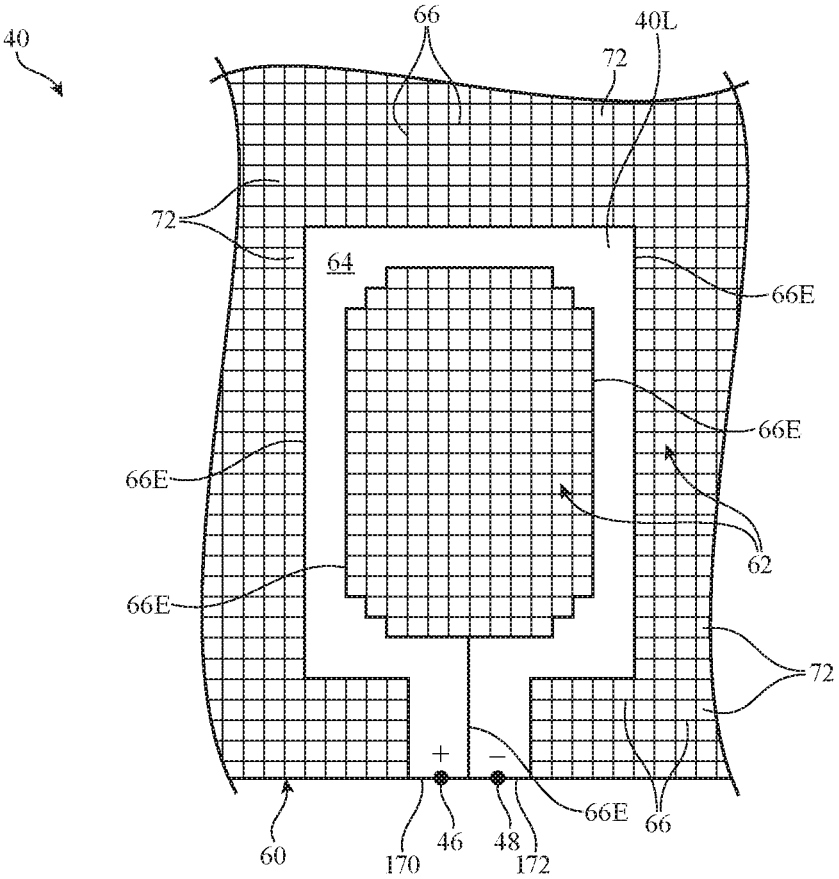
FIG. 12 is a top-down view of an illustrative loop antenna formed from a conductive layer having radio-frequency transparent patterned regions in accordance with an embodiment.

FIG. 12 is a top-down view showing how an antenna resonating element such as loop antenna resonating element 40L of FIG. 11 may be integrated within conductive layer 60. As shown in FIG. 12, patterned region 62 of conductive layer 60 may define the edges of un-patterned region 64 of conductive layer 60 (e.g., un-patterned region 64 may be surrounded by region 62 and the shape of un-patterned region 64 may be defined by region 62). A set of slots 66 in patterned region 62 such as slots 66E (sometimes referred to herein as edge slots, boundary slots, or border slots) may define the boundary between un-patterned region 64 and patterned region 62 (e.g., the edge of conductive material within un-patterned region 64 may be defined by edge slots 66E). The conductive patches within patterned region 62 may be separated from un-patterned region 64 by at least a corresponding edge slot 66E.

In the example of FIG. 12, un-patterned region 64 follows a loop path between a first end 170 and a second end 172 and forms loop antenna resonating element 40L. Positive antenna feed terminal 46 may be coupled to end 170 of un-patterned region 64 whereas ground antenna feed terminal 48 is coupled to end 172 of un-patterned region 64. Ends 170 and 162 of un-patterned region 64 may be isolated by a given edge slot 64E if desired (e.g., in scenarios where optional element 160 does not bridge feed terminals 46 and 48 as shown in FIG. 11).

Patterned region 62 may include a first portion that is enclosed by the loop path of loop antenna resonating element 40L and a second portion that surrounds the loop path of loop antenna resonating element 40L, for example. Slots 66 within patterned region 62 may be arranged in a grid that divides conductive layer 60 into an array of conductive patches such as patches 72 (e.g., rectangular patches 72 as shown in FIG. 4). This example is merely illustrative. In general, slots 66 may define patches of any desired dimensions and shapes (e.g., hexagonal patches such as patches 92 of FIG. 5, triangular patches 102 of FIG. 6, rounded patches such as patches 112 of FIG. 7 or patches 122 of FIG. 8, etc.). In another suitable arrangement, slots 66 may form a polarizer as shown in FIG. 9. In general, any desired combination of patches of any different shapes, sizes, and dimensions may be used.

Because slots 66 and patches 72 within patterned region 62 are transparent to electromagnetic waves at the operational frequency of loop antenna resonating element 40L (e.g., at a radio frequency greater than or equal to 700 MHz), patterned region 62 may appear as an open circuit to antenna currents at the operational frequency of resonating element 40L (e.g., the antenna currents may be blocked from flowing into patterned region 62). This may allow the antenna current to flow between terminals 46 and 48 over the conductive loop path of antenna resonating element 40L (e.g., over the continuous conductive path of un-patterned region 64) without shorting to other portions of conductive layer 60, thereby contributing to the resonance of antenna 40 and the transmission/reception of wireless signals corresponding to the antenna currents with a satisfactory antenna efficiency (e.g., similar to as if element 40L were formed from a conductor in free space).

In the diagram of FIG. 12, slots 66 are shown as darkened lines for the sake of clarity. However, in practice, slots 66 may be free of the conductive material of conductive layer 60 and may have a width 76 that is unresolvable by (e.g., invisible to) the un-aided human eye (e.g., less than 100 microns). This may allow all of the conductive patches 72 in patterned region 62 to appear as single continuous portion of conductive material within layer 60. Similarly, region 62 may appear as a single continuous portion of conductive material with un-patterned portion 64. In other words, conductive layer 60 may appear to a user as a single continuous piece of conductor (e.g., metal), even though slots 66 and a fully-functioning antenna resonating element 40L are formed therein.

Figure 13:
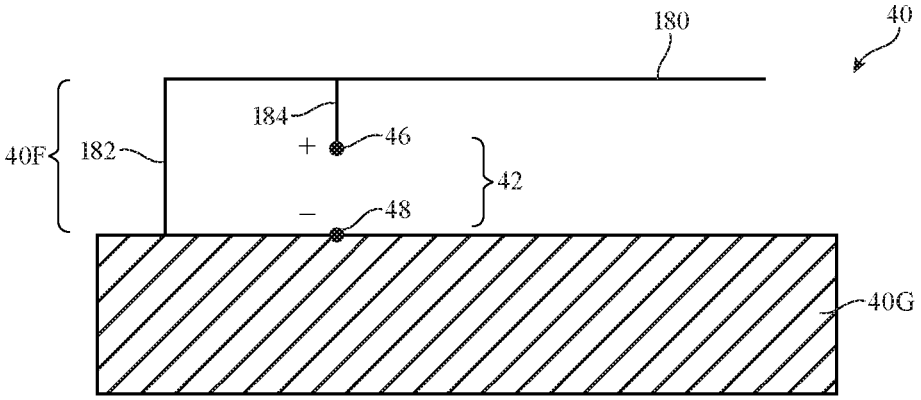
FIG. 13 is a schematic diagram of an illustrative inverted-F antenna that may be used in an electronic device in accordance with an embodiment.

If desired, antenna 40 may be formed using inverted-F antenna structures. FIG. 13 is a schematic diagram showing how antenna 40 may be formed using inverted-F antenna structures. As shown in FIG. 13, antenna 40 may include may include an inverted-F antenna resonating element 40F and antenna ground (ground plane) 40G. Antenna resonating element 40F may have a main resonating element arm such as arm 180. The length of arm 180 and/or portions of arm 180 may be selected so that antenna 40 resonates at a desired operating frequency. For example, the length of arm 180 may be a quarter of a wavelength at a desired operating frequency for antenna 40.

Main resonating element arm 180 may be coupled to ground 40G by return (short circuit) path 182. If desired, an inductor or other component (e.g., an antenna tuning component) may be interposed in path 182 and/or may be coupled in parallel with path 182 between arm 180 and ground 40G. Main resonating element arm 180 may follow a straight path or may follow a curved or meandering path.

Antenna feed 42 may run in parallel to return path 182 between arm 180 and ground 40G. For example, positive antenna feed terminal 46 of antenna feed 42 may be coupled to feed leg 184 of resonating element 40F. Ground antenna feed terminal 48 may be coupled to ground 40G. If desired, feed 42 may be formed at other locations along arm 180 or feed leg 184 may be omitted. If desired, antenna 40 may include more than one resonating arm branch (e.g., to create multiple frequency resonances to support operations in multiple communication bands) or may have other antenna structures (e.g., parasitic antenna resonating elements, tunable components to support antenna tuning, etc.). For example, arm 180 may have left and right branches that extend outwardly from feed 42 and return path 182. Multiple feeds may be used if desired.

Figure 14:
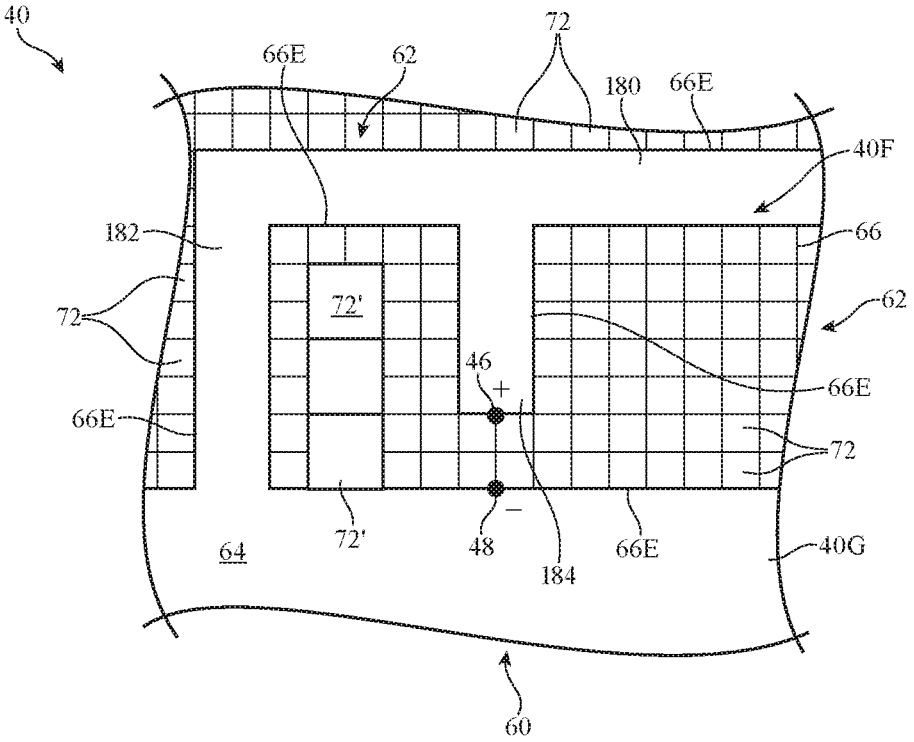
FIG. 14 is a top-down view of an illustrative inverted-F antenna formed from a conductive layer having radio-frequency transparent patterned regions in accordance with an embodiment.

FIG. 14 is a top-down view showing how antenna elements such as inverted-F antenna resonating element 40F and antenna ground 40G of FIG. 13 may be integrated within conductive layer 60. As shown in FIG. 14, patterned region 62 of conductive layer 60 may define the edges of un-patterned region 64 of conductive layer 60 (e.g., the shape of un-patterned region 64 may be defined by region 62). Edge slots 66E may define the boundary between un-patterned region 64 and patterned region 62 (e.g., the edges of conductive material within un-patterned region 64 may be defined by edge slots 66E). The conductive patches within patterned region 62 may be separated from un-patterned region 64 by at least a corresponding edge slot 66E.

In the example of FIG. 14, un-patterned region 64 forms inverted-F antenna resonating element 40F (e.g., main resonating element arm 180, return path 182, and feed leg 184) and antenna ground 40G. Positive antenna feed terminal 46 may be coupled to feed leg 184 of un-patterned region 64 whereas ground antenna feed terminal 48 is coupled to end ground 40G of un-patterned region 64. Feed leg 184 may be omitted and terminal 46 may be coupled to arm 180 if desired.

Slots 66 within patterned region 62 may be arranged in a grid and may divide conductive layer 60 into an array of conductive patches such as patches 72 (e.g., rectangular patches 72 as shown in FIG. 4). This example is merely illustrative. In general, slots 66 may define patches of any desired dimensions and shapes (e.g., hexagonal patches such as patches 92 of FIG. 5, triangular patches 102 of FIG. 6, rounded patches such as patches 112 of FIG. 7 or patches 122 of FIG. 8, etc.). In another suitable arrangement, slots 66 may form a polarizer as shown in FIG. 9. In general, any desired combination of patches of any different shapes, sizes, and dimensions may be used.

In the example of FIG. 14, patterned region 62 includes a set of larger conductive patches 72' that have a lateral surface area that is greater than the other conductive patches 72 in region 62. For example, patches 72' may have approximately four times the surface area as patches 72. When placed at a suitable location in layer 70, larger patches 72' may have a negligible impact on the efficiency of antenna 40. In the example of FIG. 14, patches 72' may be formed in region 62 between return path 182 and antenna feed 42 without affecting the efficiency of antenna 40. This example is merely illustrative and, in general, patches 72' may be formed at any desired location relative to resonating element 40F. Larger patches such as patches 72' within region 62 may serve to increase the visual continuity of region 62 to a user relative to scenarios where only smaller patches such as patches 72 are used, for example.

Because slots 66, patches 72, and patches 72' within patterned region 62 are transparent to electromagnetic waves at the operational frequency of inverted-F antenna resonating element 40F, patterned region 62 may appear as an open circuit to antenna currents at the operational frequency of resonating element 40F. This may allow the antenna current to flow between terminals 46 and 48 and across resonating element 40F and portions of antenna ground 40G (e.g., over the continuous conductive path of un-patterned region 64) without shorting to other portions of conductive layer 60, thereby contributing to the resonance of antenna 40 and the transmission/reception of wireless signals corresponding to the antenna currents with a satisfactory antenna efficiency (e.g., similar to as if element 40F were formed from a conductor in free space).

In the diagram of FIG. 14, slots 66 are shown as darkened lines for the sake of clarity. However, in practice, slots 66 may be free from the conductive material of conductive layer 60 and may have a width 76 that is unresolvable by (e.g., invisible to) the un-aided human eye (e.g., less than 100 microns). This may allow all of the conductive patches 72 and 72' in patterned region 62 to appear as single continuous portion of conductive material within layer 60. Similarly, region 62 may appear as a single continuous portion of conductive material with un-patterned portion 64. In other words, conductive layer 60 may appear to a user as a single piece of conductor (e.g., metal), even though slots 66 and a fully-functioning antenna resonating element 40F are formed therein.

Figure 15:
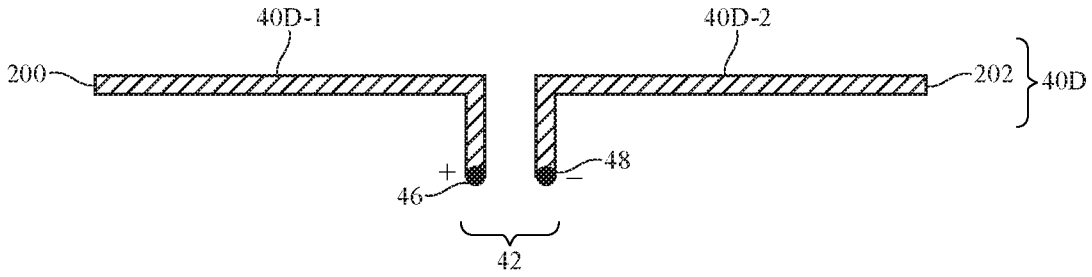
FIG. 15 is a schematic diagram of an illustrative dipole antenna that may be used in an electronic device in accordance with an embodiment.

If desired, antenna 40 may be formed using dipole antenna structures. FIG. 15 is a schematic diagram showing how antenna 40 may be formed using dipole antenna structures. As shown in FIG. 15, antenna 40 may include may include a dipole antenna resonating element 40D. Antenna resonating element 40D may have first and second arms such as arms 40D-1 and 40D-2 and may be fed by antenna feed 42. Positive antenna feed terminal 46 may be coupled to an end of dipole antenna resonating element arm 40D-1. Ground antenna feed terminal 48 may be coupled to an end of dipole antenna resonating element arm 40D-2. The length of arms 40D-1 and 40D-2 may be selected so that antenna 40 resonates at a desired operating frequency. For example, the length from end 200 of arm 40D-1 to end 202 of arm 40D-2 may be a half of a wavelength at a desired operating frequency for antenna 40. Arms 40D1 and/or 40D2 may follow straight, curved, or meandering paths if desired.

Figure 16:
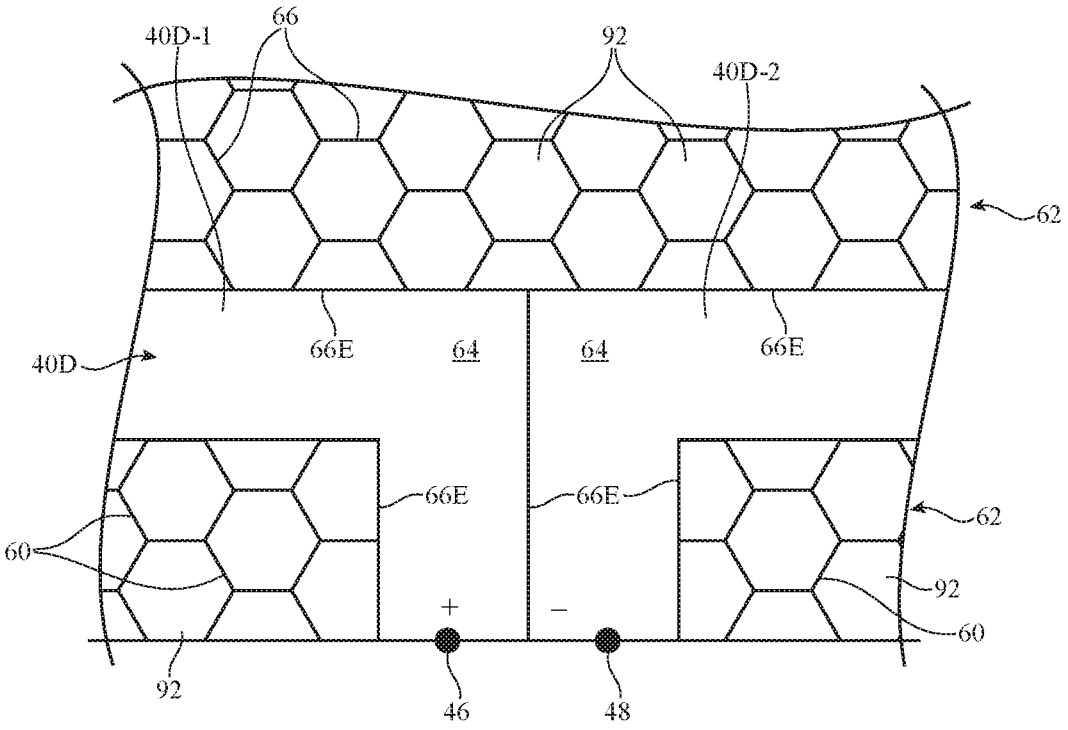
FIG. 16 is a top-down view of an illustrative dipole antenna formed from a conductive layer having radio-frequency transparent patterned regions in accordance with an embodiment.

FIG. 16 is a top-down view showing how an antenna resonating element such as dipole antenna resonating element 40D of FIG. 15 may be integrated within conductive layer 60. As shown in FIG. 16, patterned region 62 of conductive layer 60 may define the edges of un-patterned region 64 of conductive layer 60 (e.g., the shape of un-patterned region 64 may be defined by region 62). Edge slots 66E may define the boundary between un-patterned region 64 and patterned region 62 (e.g., the edges of conductive material within un-patterned region 64 may be defined by edge slots 66E). The conductive patches within patterned region 62 may be separated from un-patterned region 64 by at least a corresponding edge slot 66E.

In the example of FIG. 16, un-patterned region 64 forms dipole antenna resonating element 40D (e.g., first and second arms 40D-1 and 40D-2). Positive antenna feed terminal 46 may be coupled to arm 40D-1 on un-patterned region 64 whereas ground antenna feed terminal 48 is coupled to arm 40D-2 on un-patterned region 64. A given edge slot 66E may separate (isolate) arm 40D-1 from arm 40D-2.

Slots 66 within patterned region 62 may be arranged in a grid and may divide conductive layer 60 into an array of conductive patches such as patches 92 (e.g., hexagonal patches 92 as shown in FIG. 5). This example is merely illustrative. In general, slots 66 may define patches of any desired dimensions and shapes (e.g., rectangular patches such as patches 72 of FIG. 4, triangular patches 102 of FIG. 6, rounded patches such as patches 112 of FIG. 7 or patches 122 of FIG. 8, etc.). In another suitable arrangement, slots 66 may form a polarizer as shown in FIG. 9. Hexagonal patches 92 may allow dipole antenna resonating element 40D to operate at with higher antenna efficiency than other patch shapes, for example. In general, any desired combination of patches of any different shapes, sizes, and dimensions may be used.

Because slots 66 and patches 92 within patterned region 62 are transparent to electromagnetic waves at the operational frequency of dipole antenna resonating element 40D, patterned region 62 may appear as an open circuit to antenna currents at the operational frequency of resonating element 40D. This may allow antenna current to flow to and from terminals 46 and 48 over the continuous conductive paths formed by un-patterned region 64 without shorting to other portions of conductive layer 60 (e.g., region 62 may serve to block the antenna currents from flowing into region 62), thereby contributing to the resonance of antenna 40 and the transmission/reception of wireless signals corresponding to the antenna currents with a satisfactory antenna efficiency (e.g., similar to as if antenna resonating element 40D were formed from a conductor in free space).

In the diagram of FIG. 16, slots 66 are shown as darkened lines for the sake of clarity. However, in practice, slots 66 may be free from the conductive material of conductive layer 60 and may have a width 76 that is unresolvable by the un-aided human eye (e.g., less than 100 microns). This may allow all of the conductive patches 92 in patterned region 62 to appear as single continuous portion of conductive material within layer 60. Similarly, region 62 may appear as a single continuous portion of conductive material with un-patterned portion 64. In other words, conductive layer 60 may appear to a user as a single piece of conductor (e.g., metal), even though slots 66 and a fully-functioning antenna resonating element 40D are formed therein. If desired, dipole element 40D may be modified to form a monopole element by omitting second arm 40D-2 and extending the length of arm 40D-1 to half of a wavelength of operation for the antenna, for example.

In the examples of FIGS. 11-16, conductive layer 60 may be formed on a first surface of dielectric substrate 80 and may optionally be covered by dielectric cover layer 83 (e.g., as shown in FIG. 4 and regardless of the particular shape of the conductive patches in region 62). If desired, a portion of the antenna ground for antenna 40 may be formed from conductive traces within substrate 80 or on an opposing second surface of substrate 80. In this scenario, conductive vias or other conductive structures may extend through substrate 80 to short portions of layer 60 and/or terminal 48 to the conductive traces. In another suitable arrangement, substrate 80 may be omitted. In this scenario, dielectric adhesive may be formed within slots 66 to bind the conductive patches in patterned region 62 together.

Figure 17:
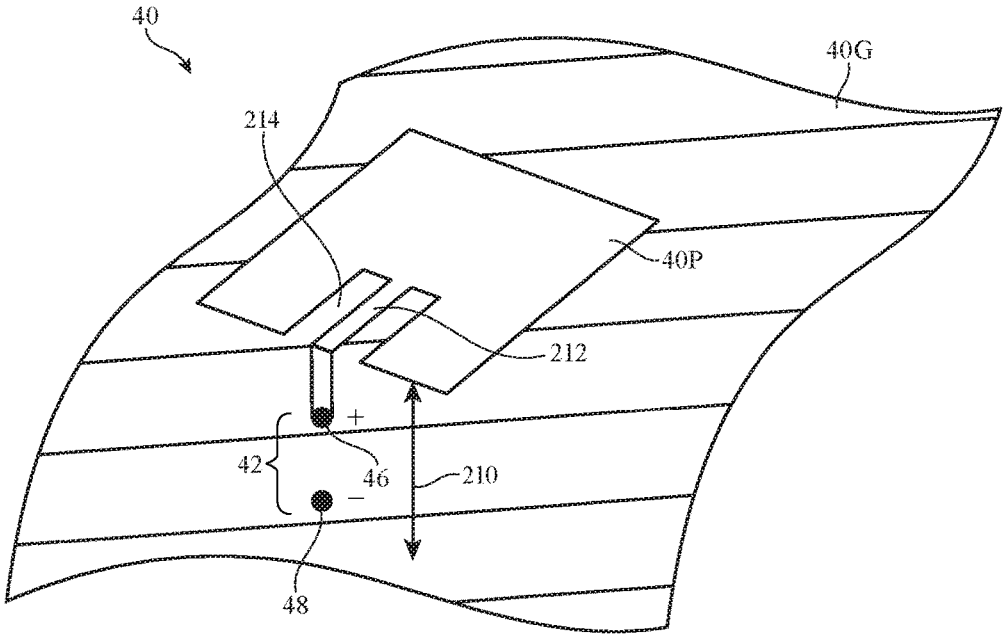
FIG. 17 is a perspective view of an illustrative patch antenna that may be used in an electronic device in accordance with an embodiment.

If desired, antenna 40 may be formed using patch antenna structures. FIG. 17 is a schematic diagram showing how antenna 40 may be formed using patch antenna structures. As shown in FIG. 17, antenna 40 may include may include a patch antenna resonating element 40P that is separated from and parallel to a ground plane such as antenna ground 40G. Arm 212 may be coupled between patch antenna resonating element 40P and positive antenna feed terminal 46 of antenna feed 42. Ground antenna feed terminal 48 may be coupled to ground plane 40G. Patch antenna resonating element 40P may be separated from ground plane 40G by distance 210.

The example of FIG. 17 is merely illustrative. If desired, patch antenna resonating element 40P may have different shapes and orientations (e.g., planar shapes, curved patch shapes, patch element shapes with non-rectangular outlines, shapes with straight edges such as squares, shapes with curved edges such as ovals and circles, shapes with combinations of curved and straight edges, etc.). If desired, impedance matching notches 214 may be formed in patch antenna resonating element 40P to help match the impedance of element 40P to the impedance of transmission line 44. The length of the sides of patch antenna resonating element 40P may be selected so that antenna 40 resonates at a desired operating frequency. For example, the lengths of the sides of element 40P may be a half of a wavelength at a desired operating frequency for antenna 40.

Figure 18:
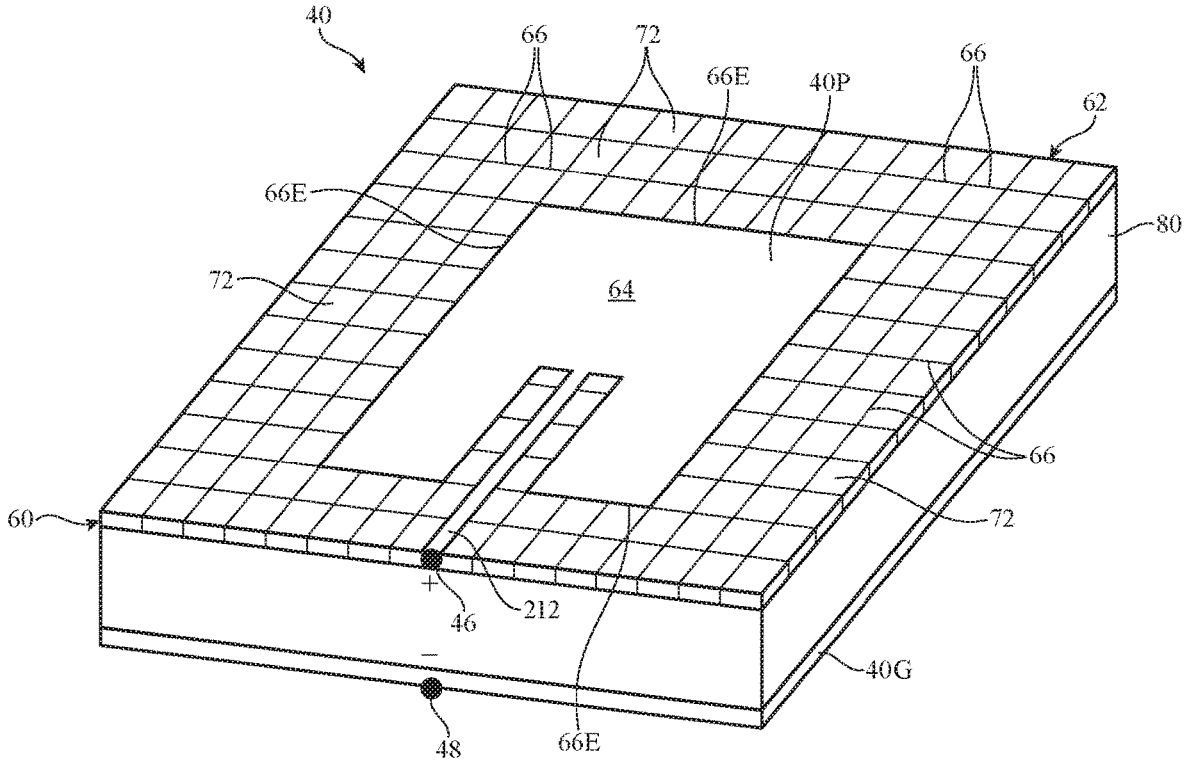
FIG. 18 is a perspective view of an illustrative patch antenna formed from a conductive layer having radio-frequency transparent patterned regions in accordance with an embodiment.

FIG. 18 is a perspective view showing how antenna elements such as patch antenna resonating element 40P of FIG. 17 may be integrated within conductive layer 60. As shown in FIG. 18, patterned region 62 of conductive layer 60 may define the edges of un-patterned region 64 of conductive layer 60 (e.g., the shape of un-patterned region 64 may be defined by region 62). Edge slots 66E may define the boundary between un-patterned region 64 and patterned region 62 (e.g., the edges of conductive material within un-patterned region 64 may be defined by edge slots 66E). The conductive patches within patterned region 62 may be separated from un-patterned region 64 by at least a corresponding edge slot 66E.

In the example of FIG. 18, conductive layer 60 may be formed on a first surface of substrate 80. Ground plane 40G may be formed on the opposing second surface of substrate 80. Un-patterned region 64 of conductive layer 60 forms patch antenna resonating element 40P and arm 212. Positive antenna feed terminal 46 may be coupled to an end of arm 212 of un-patterned region 64 whereas ground antenna feed terminal 48 is coupled to ground plane 40G on the opposing surface of substrate 80.

Slots 66 within patterned region 62 may be arranged in a grid that divides conductive layer 60 into an array of conductive patches such as patches 72 (e.g., rectangular patches 72 as shown in FIG. 4). This example is merely illustrative. In general, slots 66 may define patches of any desired dimensions and shapes (e.g., hexagonal patches such as patches 92 of FIG. 5, triangular patches 102 of FIG. 6, rounded patches such as patches 112 of FIG. 7 or patches 122 of FIG. 8, etc.). In another suitable arrangement, slots 66 may form a polarizer as shown in FIG. 9. In general, any desired combination of patches of any different shapes, sizes, and dimensions may be used.

Because slots 66 and patches 72 within patterned region 62 are transparent to electromagnetic waves at the operational frequency of patch antenna resonating element 40P, patterned region 62 may appear as an open circuit to antenna currents at the operational frequency of resonating element 40P. This may allow the antenna current to flow to and from terminal 46 over the continuous conductive path of un-patterned region 64 without shorting to other portions of conductive layer 60, thereby contributing to the resonance of antenna 40 and the transmission/reception of wireless signals corresponding to the antenna currents with a satisfactory antenna efficiency (e.g., similar to as if element 40P were formed from a conductor in free space).

In the diagram of FIG. 18, slots 66 are shown as darkened lines for the sake of clarity. However, in practice, slots 66 are free of the conductive material of conductive layer 60 and may have a width that is unresolvable by (e.g., invisible to) the un-aided human eye (e.g., less than 100 microns). This may allow all of the conductive patches 72 in patterned region 62 to appear as single continuous portion of conductive material within layer 60. Similarly, region 62 may appear as a single continuous portion of conductive material with un-patterned portion 64. In other words, conductive layer 60 may appear to a user as a single piece of conductor (e.g., metal), even though slots 66 and a fully-functioning antenna resonating element 40P are formed therein. Conductive layer 60 need not have a uniform thickness across its lateral area.

The examples of FIGS. 11-18 are merely illustrative. If desired, combinations of inverted-F antenna structures, patch antenna structures, dipole antenna structures, monopole antenna structures, loop antenna structures, ground plane structures, or other antenna structures may be used in forming antenna 40 from conductive layer 60. Multiple antennas 40 may be formed in a single conductive layer 60 if desired (e.g., multiple antennas 40 arranged in a phased antenna array). If desired, multiple conductive layers 60 having integrated antenna resonating elements may be formed within substrate 80 or vertically stacked with respect to each other. If desired, some portions of layer 60 may be thicker than other portions of conductive layer 60.

Figure 19:
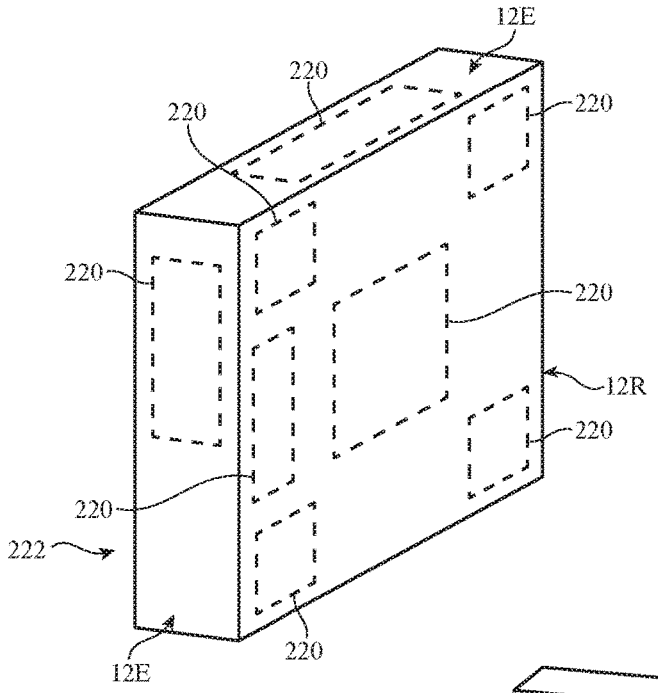
FIGS. 19 and 20 are perspective views of illustrative electronic devices showing locations at which an antenna of the type shown in FIGS. 2-18 may be formed in accordance with embodiments.

FIG. 19 is a perspective view of electronic device 10 showing illustrative locations 220 in which antenna 40 may be mounted in device 10. As shown in FIG. 19, device 10 may include housing 12. Housing 12 may include a rear housing wall 12R and housing sidewalls 12E. In one suitable arrangement, a display may be mounted to front side 222 of housing 12 opposite rear housing wall 12R. Portions of housing 12 may be formed on side 222 if desired.

In the example of FIG. 19, housing walls 12R and 12E are peripheral housing structures that run around the periphery of device 10. Housing 12 may be implemented using peripheral housing structures that have a rectangular ring shape with four corresponding sidewalls 12E (as an example). Housing sidewalls 12E may serve as a bezel for a display on device 10 (e.g., a cosmetic trim that surrounds all four sides of the display and/or that helps hold the display to device 10, a metal band with vertical sidewalls, curved sidewalls, etc.).

Peripheral housing structures 12E and 12R may be formed of a conductive material such as metal and may therefore sometimes be referred to as peripheral conductive housing structures, conductive housing structures, peripheral metal structures, or a peripheral conductive housing member (as examples). Peripheral housing structures 12E and 12R may be formed from a metal such as stainless steel, aluminum, or other suitable materials. One, two, or more than two separate structures may be used in forming peripheral housing structures 12E and 12R.

Sidewalls 12E may be substantially straight vertical sidewalls, may be curved, or may have other suitable shapes. Rear housing wall 12R may lie in a plane that is parallel to the display on front side 222 of device 10. In configurations for device 10 in which the rear surface of housing 12R is formed from metal, rear housing wall 12R may be formed from a planar metal structure and housing sidewalls 12E may be formed as vertically extending integral metal portions of the planar metal structure. Housing structures such as these may, if desired, be machined from a block of metal and/or may include multiple metal pieces that are assembled together to form housing 12. Planar rear wall 12R may have one or more, two or more, or three or more portions.

Conductive layers 60 having integral antenna elements for one or more antennas 40 (e.g., as described above in connection with FIGS. 3-18) may be used to form some or all of one or more sidewalls 12E, may be used to form some or all of rear wall 12R, and/or may be used to form a portion of the front side 222 of device 10 (e.g., conductive layer 60 may include conductive portions of housing 12). In these scenarios, layer 60 and antenna 40 are formed at the exterior of device 10. For example, antenna 40 may be mounted at locations 220 at the corners of device 10, along the edges of housing 12 such as on sidewalls 12E, on upper or lower portions of rear housing portion 12R, in the center of rear housing 12R, etc. If desired, conductive layers 60 may be located within housing 12 of device 10 (e.g., conductive layer 60 may be formed from a layer of conductive traces on a substrate such as a printed circuit substrate or glass substrate within device 10). In another suitable arrangement, a display may be formed at side 222 of device 10. The display may include active circuitry that emits light (e.g., liquid crystal display circuitry, light emitting diode display circuitry, etc.). The display may be covered by a display cover layer such as a glass or sapphire layer. The active circuitry may emit the light through the display cover layer. The display cover layer may cover all of side 222 (e.g., extending across a length and width of device 10) or may cover only some of side 222. Conductive layer 60 may be formed from a metal coating over some or all of an interior or exterior surface of the display cover layer if desired.

Figure 20:
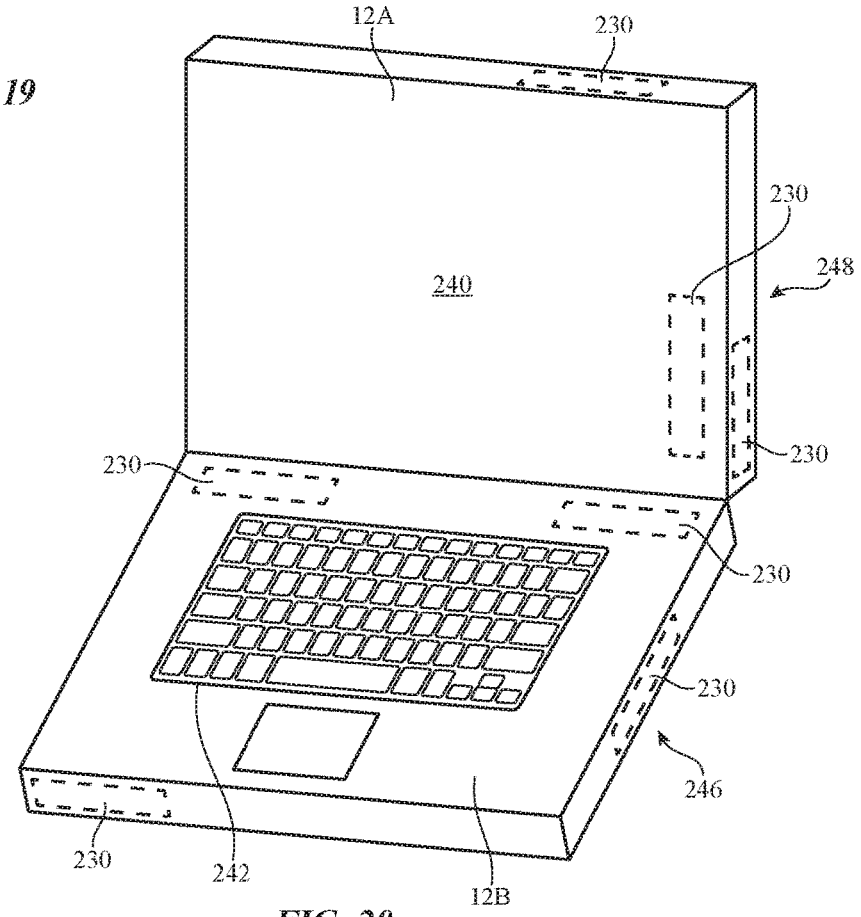

FIG. 20 is a perspective view showing how electronic device 10 may be a laptop computer. As shown in FIG. 20, antenna 40 may be formed at illustrative locations such as locations 230 on device 10. Housing 12 may include an upper housing portion 12A and a lower housing portion 12B. A display such as display 240 may be formed within upper housing portion 12A whereas an input-output device such as keyboard 242 is formed in lower housing portion 12B. Conductive housing portion 12A may be coupled to housing portion 12B by a hinge that configures portion 12A to rotate with respect to portion 12B. Some or all of the exterior surfaces of housing portions 12A and 12B may be formed from conductive structures such as conductive layer 60 having integral antenna components (e.g., as described above in connection with FIGS. 3-18). Antenna 40 in conductive layer 60 may be formed on the same side of housing portion 12B as keyboard 242, on a side of portion 12B that opposes keyboard 242 such as side 246, on the same side of housing portion 12A as display 240, on a side of portion 12A that opposes display 240 such as side 248, or at any other desired location on the interior or exterior of device 10.

The examples of FIGS. 19 and 20 are merely illustrative and, in general, device 10 may be any desired type of electronic device having any desired form factor. If desired, device 10 may be a wearable electronic device such as a wrist watch, pendant device, or eyewear device (e.g., a virtual or augmented reality device, eyeglasses, sunglasses, etc.). For example, substrate 80 for conductive layer 60 may be formed using glass or other transparent lenses in a pair of eyeglasses or sunglasses, from a transparent crystal for a wrist watch, etc. If desired, device 10 may be integrated within a larger system or apparatus such as a vehicle, building, or electronic kiosk. For example, substrate 80 for conductive layer 60 may be formed from a glass window such as a glass window of a building, vehicle (e.g., car, airplane, boat, etc.) or electronic kiosk.

Figure 21:
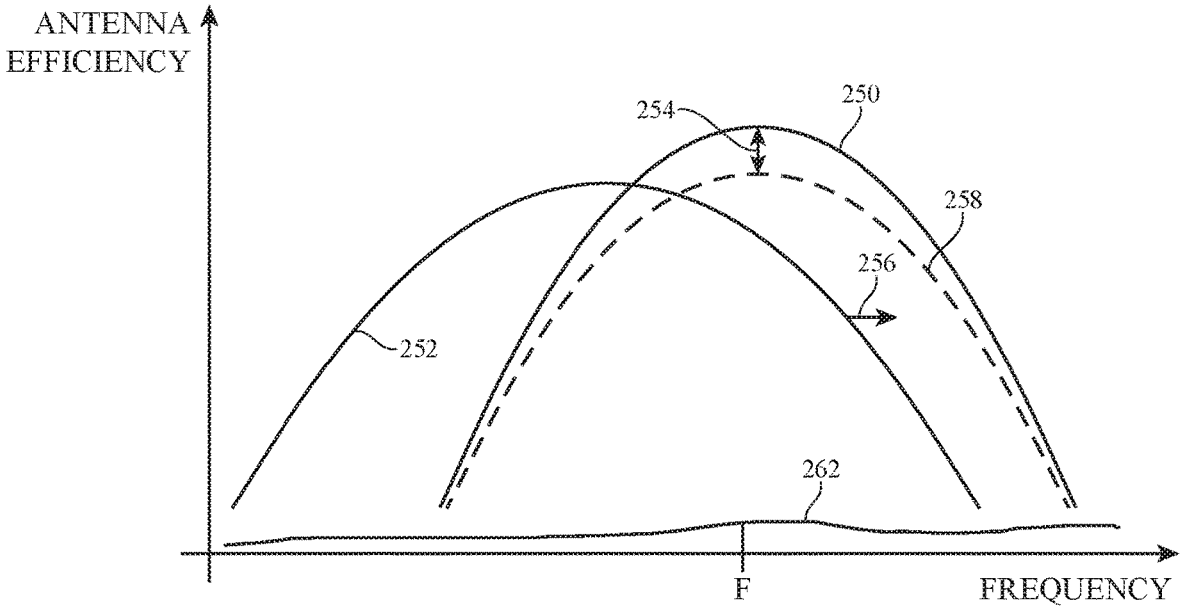
FIG. 21 is a graph of antenna performance (antenna efficiency) for an illustrative antenna of the type shown in FIGS. 2-18 in accordance with an embodiment.

FIG. 21 is a graph of antenna performance (antenna efficiency) as a function of frequency for an illustrative antenna of the type shown in FIGS. 2-18. As shown in FIG. 21, curve 250 illustrates the efficiency of antenna 40 when formed in a free space environment (e.g., in scenarios where antenna 40 is not formed in conductive layer 60). Curve 250 may exhibit a peak antenna efficiency at an operational frequency F of antenna 40 (e.g., a radio frequency greater than or equal to 700 MHz). Curve 252 illustrates one possible efficiency of antenna 40 when formed in conductive layer 60 (e.g., as described above in connection with FIGS. 2-18). Curve 252 may exhibit a peak antenna efficiency that is offset from frequency F. Matching circuitry 54 may serve to shift curve 252 in frequency back towards operational frequency F, as shown by arrow 256. Dashed curve 258 may illustrate the efficiency of antenna 40 after compensation using matching circuitry 54. Antenna 40 within conductive layer 60 may have a peak antenna efficiency that is offset from the peak efficiency of the free-space antenna associated with curve 250 by offset 254 (e.g., due to the influence of conductive structures such as patches 72 of FIG. 4 in the vicinity of un-patterned region 64 of layer 60, etc.). By selecting suitable dimensions for slots 66 and the corresponding patches within patterned region 62 (e.g., based on curve 140 of FIG. 10), offset 254 may be sufficiently small (e.g., approximately zero, less than 1 dB, or less than 0.5 dB) so as to not significantly affect the successful transmission and reception of wireless data using antenna 40. At the same time, slots 66 in region 62 may be small enough to be effectively invisible to the user of device 10, such that un-patterned region 64 (and thus antenna 40) is visually indistinguishable from patterned region 62 of layer 60 and layer 60 appears to a user as a single continuous piece of metal. In scenarios where slots 66 are omitted, the resonating element of antenna 40 will be shorted to the entirety of conductive layer 60 and the antenna will exhibit a degraded efficiency as shown by curve 262.

The example of FIG. 21 is merely illustrative. In general, the efficiency curve associated with antenna 40 may have any desired shape. Antenna 40 may exhibit peaks in efficiency at more than one frequency (e.g., in scenarios where antenna 40 is a multi-band antenna). Antenna 40 may exhibit a peak efficiency at operational frequency F without the need for matching network 54 in some examples (e.g., forming antenna 40 in layer 60 may not significantly shift the resonant frequency of antenna 40).

The foregoing is merely illustrative and various modifications can be made to the described embodiments. The foregoing embodiments may be implemented individually or in any combination.

What is claimed is:

1. Apparatus comprising:

a dielectric substrate; and a conductive layer on the dielectric substrate that is patterned to form a first region and a second region that surrounds at least some of the first region, wherein the first region forms an antenna resonating element for an antenna and is configured to conduct antenna currents, the second region comprises a grid of openings in the conductive layer and is configured to block the antenna currents, the first region comprises a solid region of the conductive layer, the second region defines edges of the solid region and the antenna resonating element, the conductive layer is continuous and free from openings within the solid region and between the edges of the antenna resonating element, the second region includes an array of conductive patches that are separated by the grid of openings, and the second region is transparent to radio-frequency signals.

2. The apparatus defined in claim 1, wherein the openings in the grid have a lateral surface area, the second region has a total lateral surface area that includes the lateral surface area of the openings, and a ratio of the lateral surface area of the openings to the total lateral surface area of the second region is less than 20%.

3. The apparatus defined in claim 2, wherein the antenna comprises a loop antenna, the antenna resonating element comprises a loop antenna resonating element formed from the first region of the conductive layer, and the second region of the conductive layer comprises a first portion that surrounds the loop antenna resonating element and a second portion that is surrounded by the loop antenna resonating element.

4. The apparatus defined in claim 1, wherein the plurality of conductive patches comprises conductive patches selected from the group consisting of:

hexagonal conductive patches, rectangular conductive patches, triangular rectangular patches, circular conductive patches, and elliptical conductive patches.

5. The apparatus defined in claim 1, wherein each of the openings in the grid has a width that is less than 100 microns.

6. The apparatus defined in claim 5, wherein each of the conductive patches in the plurality of conductive patches has a maximum lateral dimension that is greater than 0.1 mm and less than 5 mm.

7. The apparatus defined in claim 6, wherein the dielectric substrate comprises a glass window.

8. The apparatus defined in claim 1, wherein the openings in the grid of openings have a lateral surface area, the second region has a total lateral surface area that includes the lateral surface area of the openings, and a ratio of the lateral surface area of the openings to the total lateral surface area of the second region is between 0.1% and 10%.

9. The apparatus defined in claim 1, wherein the antenna comprises an inverted-F antenna having an antenna ground, the antenna resonating element comprises an inverted-F antenna resonating element arm formed from the solid region, and the solid region forms at least part of the antenna ground for the inverted-F antenna.

10. The apparatus defined in claim 1, wherein the antenna comprises a dipole antenna having first and second feed terminals, the antenna resonating element comprises first and second dipole antenna resonating element arms formed from the solid region, the first feed terminal is coupled to the first dipole antenna resonating element arm, the second feed terminal is coupled to the second dipole antenna resonating element arm, and the array of conductive patches in the second region surrounds the first and second dipole antenna resonating element arms in the conductive layer.

11. The apparatus defined in claim 1, wherein the dielectric substrate has opposing first and second surfaces, the conductive layer is formed on the first surface, the antenna comprises an antenna ground formed on the second surface, the antenna comprising a patch antenna, and the antenna resonating element comprises a patch antenna resonating element formed from the solid region.

12. The apparatus defined in claim 1, wherein each conductive patch in the array of conductive patches has a maximum lateral dimension that is between 0.1 mm and 5 mm.

13. The apparatus defined in claim 1, wherein the array of conductive patches comprises first and second sets of conductive patches, each of the conductive patches in the first set has a first shape, and each of the conductive patches in the second set has a second shape that is different from the first shape.

14. The apparatus defined in claim 13, wherein the first set of conductive patches is arranged in a first set of rows and a first set of columns, the second set of conductive patches is arranged in a second set of rows and a second set of columns, the first set of rows is offset with respect to the second set of rows, and the first set of columns is offset with respect to the second of columns.

15. The apparatus defined in claim 1, wherein the second region defines at least first, second, and third edges of the solid region, the first edge extending parallel to the third edge, and the second edge extending perpendicular to the first and third edges.

16. The apparatus defined in claim 1, wherein the first region has a first reflectivity to visible light and the second region has a second reflectivity to visible light that is within 20% of the first reflectivity.

17. The apparatus defined in claim 1, wherein the apparatus comprises an electronic device, the conductive layer comprising a conductive housing wall for the electronic device.

* * * * *